US011519678B2

(12) United States Patent
Mitsuhashi et al.

(10) Patent No.: US 11,519,678 B2
(45) Date of Patent: Dec. 6, 2022

(54) HEAT EXCHANGER

(71) Applicant: KOBE STEEL, LTD., Hyogo (JP)

(72) Inventors: Kenichiro Mitsuhashi, Takasago (JP); Takashi Kogushi, Takasago (JP); Masato Yamada, Takasago (JP); Susumu Terada, Takasago (JP); Koji Noishiki, Takasago (JP)

(73) Assignee: Kobe Steel, Ltd., Hyogo (JP)

( * ) Notice: Subject to any disclaimer, the term of this patent is extended or adjusted under 35 U.S.C. 154(b) by 0 days.

(21) Appl. No.: 17/273,755

(22) PCT Filed: Sep. 3, 2019

(86) PCT No.: PCT/JP2019/034648
§ 371 (c)(1),
(2) Date: Mar. 5, 2021

(87) PCT Pub. No.: WO2020/054520
PCT Pub. Date: Mar. 19, 2020

(65) Prior Publication Data

US 2021/0199392 A1 Jul. 1, 2021

(30) Foreign Application Priority Data

Sep. 11, 2018 (JP) ..... JP2018-169773

(51) Int. Cl.
*F28D 9/00* (2006.01)
*F28F 9/02* (2006.01)

(52) U.S. Cl.
CPC ..... *F28F 9/02* (2013.01); *F28D 9/0062* (2013.01)

(58) Field of Classification Search
CPC ..... F28F 9/02; F28F 9/001; F28F 2265/16; F28F 2225/02; F28F 3/06; F28F 3/08; F28D 9/0062; F28D 9/0068; F28D 9/00
See application file for complete search history.

(56) References Cited

U.S. PATENT DOCUMENTS 4,541,480 A * 9/1985 Beckmann ..... F28F 9/001 228/183
RE33,912 E * 5/1992 Lapkowski ..... F28D 9/0037 165/DIG. 383

(Continued)

FOREIGN PATENT DOCUMENTS

EP 1 936 311 A1 6/2008
EP 2 244 046 A2 10/2010

(Continued)

OTHER PUBLICATIONS

Notification Concerning Transmittal of International Preliminary Report on Patentability and Translation of Written Opinion of the International Searching Authority; PCT/JP2019/034648 ; dated Mar. 25, 2021.

(Continued)

*Primary Examiner* — Harry E Arant
(74) *Attorney, Agent, or Firm* — Studebaker & Brackett PC

(57) ABSTRACT

A heat exchanger includes a heat exchanger body having a plurality of layer portions each having a plurality of flow paths, and having a configuration in which adjacent layer portions are joined to each other, an inflow header being configured that a fluid is introduced into the inflow header to flow into the plurality of flow paths, an outflow header being configured that a fluid flowing through the plurality of flow paths merges, a cover portion covering all joint portions of the adjacent layer portions or all joint portions of components of layer portions, the joint portions exposed on an outer surface of the heat exchanger body at a portion other than a portion where the inflow header and the outflow header are disposed, and a lead-out portion connected to the cover portion and forming an internal flow path communicating with a space between the cover portion and the heat (Continued)

exchanger body. The lead-out portion is configured to emit a fluid to a predetermined region set in advance.

16 Claims, 20 Drawing Sheets

(56) References Cited

U.S. PATENT DOCUMENTS

| | | | | |
|---|---|---|---|---|
| 2010/0205988 | A1* | 8/2010 | Jiang | F25B 1/10 62/225 |
| 2010/0263823 | A1 | 10/2010 | Mitsuhashi et al. | |
| 2013/0255924 | A1 | 10/2013 | Dietrich et al. | |
| 2014/0054022 | A1 | 2/2014 | Mitsuhashi | |
| 2017/0254598 | A1* | 9/2017 | Van Bockryck | F28D 9/0062 |
| 2017/0268826 | A1 | 9/2017 | Noishiki et al. | |
| 2018/0094859 | A1* | 4/2018 | Bardeleben | F28D 9/0043 |
| 2019/0137184 | A1 | 5/2019 | Hakamata et al. | |
| 2020/0064083 | A1 | 2/2020 | Mitsuhashi | |

FOREIGN PATENT DOCUMENTS

| | | | | |
|---|---|---|---|---|
| EP | 3 220 088 | A1 | | 9/2017 |
| JP | S53123567 | U | * | 10/1978 |
| JP | S53123567 | U | | 10/1978 |
| JP | S5812051 | Y2 | * | 3/1983 |
| JP | S5812051 | Y2 | | 3/1983 |
| JP | S61217693 | A | | 9/1986 |
| JP | S63-113298 | A | | 5/1988 |
| JP | H0619970 | Y2 | | 5/1994 |
| JP | 2531398 | B2 | | 9/1996 |
| JP | 2005069499 | A | | 3/2005 |
| JP | 2005114316 | A | | 4/2005 |
| JP | 2018091423 | A | | 6/2018 |
| KR | 10-0865115 | B1 | | 10/2008 |

OTHER PUBLICATIONS

H.Kazakov; "Vacume Diffusion Welding"; Beijing: National Defense Industry Press; Jun. 1976; pp. 1-17.

The extended European search report issued by the European Patent Office dated Mar. 9, 2022, which corresponds to European Patent Application No. 19860109.8-1002 and is related to U.S. Appl. No. 17/273,755.

* cited by examiner

HEAT EXCHANGER

TECHNICAL FIELD

The present invention relates to a heat exchanger having a plurality of layer portions each having a plurality of flow paths.

BACKGROUND ART

Conventionally, as disclosed in Patent Literatures 1 and 2, there has been known a heat exchanger including a heat exchanger body having a plurality of layer portions each having a plurality of flow paths. In this type of heat exchanger, a plurality of layer portions are laminated to each other, and adjacent layer portions are joined to each other. Heat exchange is performed between a first fluid flowing in a first flow path formed in a first layer portion of the plurality of layer portions and a second fluid flowing in a second flow path formed in a second layer portion of the plurality of layer portions.

In the heat exchanger disclosed in Patent Literature 1, a detection unit formed so as to be relatively easily damaged by thermal stress is provided further outside the outermost layer portion. By feeding nitrogen gas for gas leakage check into the detection unit, the presence or absence of gas leakage from the flow path can be detected by a pressure gauge. The detection unit itself is not configured to flow a heat exchange fluid. Since the damage at the detection unit is earlier than the damage at the layer portion, the damage at the layer portion can be predicted by detecting the damage at the detection unit.

On the other hand, in the heat exchanger disclosed in Patent Literature 2, a protection layer is provided further outside the outermost layer portion. This protection layer has the same strength as that of the layer portion constituting the laminate body. In this heat exchanger, when the heat exchange fluid leaks from the outermost layer portion to the protection layer, the protection layer can function as a portion for holding the pressure similarly to the laminate body of the layer portion. Therefore, even if a fluid leaks from the outermost layer to the protection layer, the heat exchanger can be used continuously.

In Patent Literatures 1 and 2, attention is not paid to the fact that the fluid leaks through a portion where the layer portions are joined together. Therefore, there is a problem that the operation of the heat exchanger cannot be continued when a fluid leaks through the joint portion between the layers. That is, depending on the type of fluid to be subjected to the heat exchange, it is not desirable that the fluid leaked around the heat exchanger accumulate when the fluid leak occurs, and hence the operation of the heat exchanger cannot be continued in some cases. In a case where a fluid leak occurs, it is necessary to, after stopping the operation of the heat exchanger, specify the leak location, repair the specified location, and check whether the leak occurs by applying pressure on a trial basis. This operation requires a time-consuming procedure and does not satisfy the need to continue the operation of the heat exchanger as much as possible.

CITATION LIST

Patent Literature

Patent Literature 1: Japanese Patent Laid-Open No. 2010-249475

Patent Literature 2: Japanese Patent Laid-Open No. 2014-40945

SUMMARY OF INVENTION

An object of the present invention is to prevent a problem from occurring even if the heat exchange operation is continued when a fluid leak from the heat exchanger occurs.

A heat exchanger according to one aspect of the present invention includes a heat exchanger body having a plurality of layer portions each having a plurality of flow paths, and having a configuration in which adjacent layer portions are joined to each other in a state where the plurality of layer portions are laminated, an inflow header fixed to the heat exchanger body, the inflow header being configured that a fluid is introduced into the inflow header to flow into the plurality of flow paths, an outflow header fixed to the heat exchanger body, the outflow header being configured that a fluid flowing through the plurality of flow paths merges, a cover portion covering all joint portions of the adjacent layer portions or all joint portions of components of the layer portions, the joint portions being exposed on an outer surface of the heat exchanger body at a portion other than a portion where the inflow header and the outflow header are disposed, and a lead-out portion connected to the cover portion and faulting an internal flow path communicating with a space or a gap between the cover portion and the heat exchanger body. The lead-out portion is configured to emit a fluid to a predetermined region set in advance.

DESCRIPTION OF EMBODIMENTS

Embodiments will be described below with reference to the accompanying drawings. Note that the following embodiments are examples embodying the present invention and are not intended to limit the technical scope of the present invention.

First Embodiment

Figure 1:
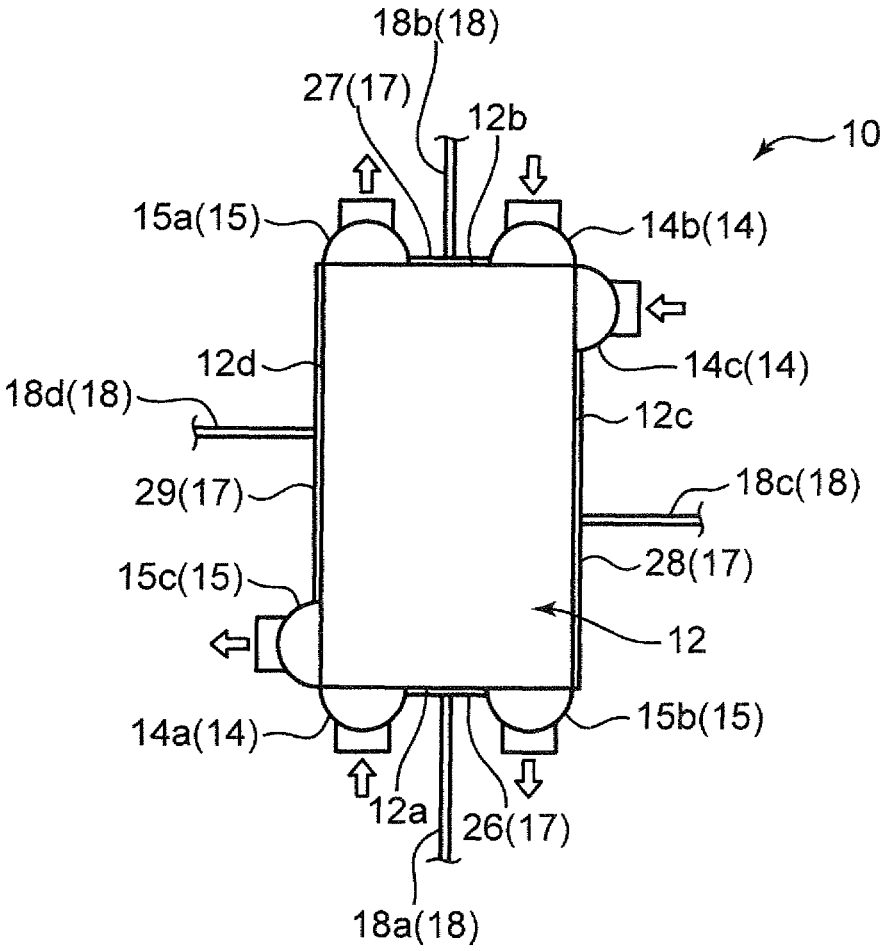
FIG. 1 is a front view showing an overall configuration of a heat exchanger according to a first embodiment.

As shown in FIG. 1, a heat exchanger 10 according to the first embodiment includes a heat exchanger body 12, which is a portion that performs heat exchange between fluids, an inflow header 14 fixed to the heat exchanger body 12, an outflow header 15 fixed to the heat exchanger body 12, a cover portion 17 fixed to the heat exchanger body 12, and a lead-out portion 18 connected to the cover portion 17. As shown also in FIG. 2, the heat exchanger body 12 is configured in a rectangular parallelepiped shape. Note that the heat exchanger 10 is used in, for example, plants handling a combustible fluid such as a natural gas treatment plant, a natural gas liquefaction plant, and an ethylene plant.

Figure 2:
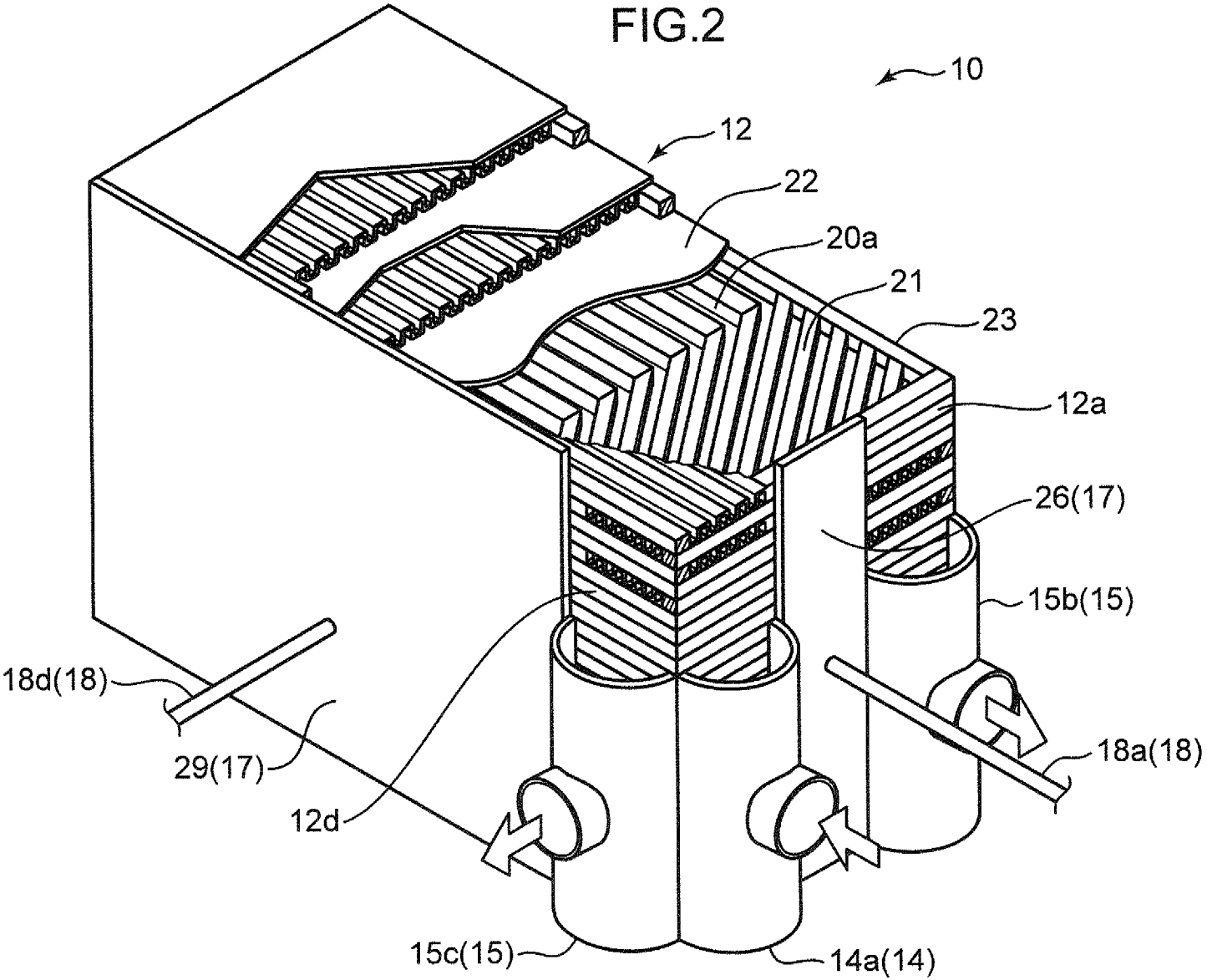
FIG. 2 is a perspective view of the heat exchanger in a state where the heat exchanger is partially broken.
Figure 3:
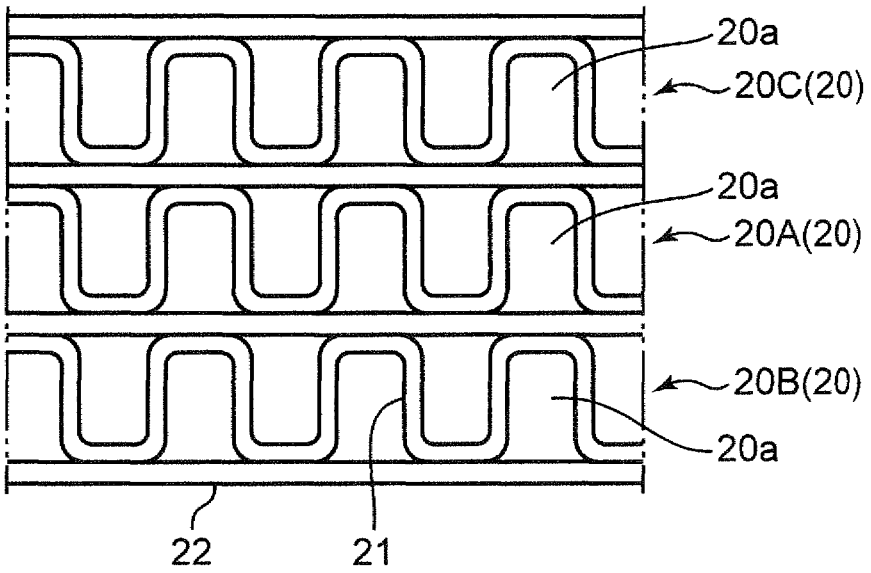
FIG. 3 is a view partially showing a layer portion formed in the heat exchanger.

The heat exchanger body 12 has a plurality of layer portions 20, and the plurality of layer portions 20 are laminated. A plurality of flow paths 20*a* are formed in each layer portion 20. In the first embodiment, as shown in FIGS. 2 and 3, each layer portion 20 has a corrugated plate 21, a partition plate 22 joined to one surface of the corrugated plate 21, and a side bar 23 surrounding the periphery of the corrugated plate 21. That is, the heat exchanger body 12 of the first embodiment is formed of a plate fin heat exchanger. The corrugated plate 21, the partition plate 22, and the side bar 23 are components of the layer portion 20.

By joining the partition plate 22 to one surface of the corrugated plate 21, the space between the corrugated plate 21 and the partition plate 22 becomes the flow path 20*a*. In the adjacent layer portions 20, the partition plate 22 of one layer portion 20 and the corrugated plate 21 of the other layer portion 20 are joined to each other, whereby the space between the partition plate 22 and the corrugated plate 21 also becomes the flow path 20*a*. Then, heat of the fluid flowing through the flow path 20*a* formed in a certain layer portion 20 is transmitted to the partition plate 22 via the corrugated plate 21, and heat of the partition plate 22 is transmitted via the corrugated plate 21 to the fluid flowing through the flow path 20*a* formed in the adjacent layer portion 20.

The corrugated plate 21 functions as a fin, and is made of an aluminum alloy, for example. The corrugated plate 21 is brazed with the aluminum alloy on the surface of the partition plate 22. The side bar 23 is also made of an aluminum alloy, for example, and brazed with the aluminum alloy on the surface of the partition plate 22. The material of the corrugated plate 21, the partition plate 22, and the side bar 23 is not limited to these, and any metal may be used as long as heat is transferred between the corrugated plate 21 and the partition plate 22.

In a state where the plurality of layer portions 20 are laminated, the layer portions 20 are joined to each other. In adjacent layer portions 20, the joint portion between the partition plate 22 of one layer portion 20 and the side bar 23 of the other layer portion 20 is exposed on the outer surface of the heat exchanger body 12. The joint portion between the partition plate 22 and the side bar 23 in a layer portion 20 is also exposed on the outer surface of the heat exchanger body 12. These joint portions are exposed on the side surface of the heat exchanger body 12. Note that the layers 20 may be joined by brazing.

The side bar 23 disposed around the corrugated plate 21 has a discontinuity, and the inflow header 14 or the outflow header 15 is attached so as to cover the discontinuity. The flow path 20*a* communicates with the inflow header 14 and the outflow header 15 through the discontinuity of the side bar 23.

In the present embodiment, in the heat exchanger body 12, heat exchange is performed among a first fluid, a second fluid, and a third fluid. That is, as the layer portion 20, there are a first layer portion 20A having the flow paths 20*a* through which the first fluid flows, a second layer portion 20B having the flow paths 20*a* through which the second fluid flows, and a third layer portion 20C having the flow paths 20*a* through which the third fluid flows. The second layer portion 20B is disposed on one side of the first layer portion 20A, and the third layer portion 20C is disposed on the other side of the first layer portion 20A. Note that the heat exchanger body 12 is not limited to the configuration in which heat exchange is performed among the three fluids, but may be a configuration in which heat exchange is performed between two fluids or a configuration in which heat exchange is performed among four or more fluids.

Since the flow paths 20*a* formed in the heat exchanger body 12 are open to the side surface of the heat exchanger body 12, the inflow header 14, the outflow header 15, and the cover portion 17 are disposed on the side surface (four sides) of the heat exchanger body 12.

The inflow header 14 has a first inflow header 14*a* having an inflow port into which the first fluid flows, a second inflow header 14*b* having an inflow port into which the second fluid flows, and a third inflow header 14*c* having an inflow port into which the third fluid flows. The first inflow header 14*a* is attached to a first side surface 12*a* of the heat exchanger body 12. The first fluid flows into the heat exchanger body 12 through the first inflow header 14*a*. The second inflow header 14*b* is attached to a second side surface 12*b*, which is the side surface opposite to the first side surface 12*a*. The second fluid flows into the heat exchanger body 12 through the second inflow header 14*b*. The third inflow header 14*c* is attached to a third side surface 12*c*, which is one of the pair of side surfaces adjacent to the first side surface 12*a* and the second side surface 12*b*. The third fluid flows into the heat exchanger body 12 through the third inflow header 14*c*.

The outflow header 15 has a first outflow header 15*a* having an outflow port from which the first fluid is led out, a second outflow header 15*b* having an outflow port from which the second fluid is led out, and a third outflow header 15*c* having an outflow port from which the third fluid is led out. The first outflow header 15*a* is attached to the second side surface 12*b* of the heat exchanger body 12. The first fluid flowing through the flow paths 20*a* in the heat exchanger body 12 merges in the first outflow header 15*a* and flows to the outside of the heat exchanger 10 through the first outflow header 15*a*. The second outflow header 15*b* is attached to the first side surface 12*a* of the heat exchanger body 12. The second fluid flowing through the flow paths 20*a* in the heat exchanger body 12 merges in the second outflow header 15*b* and flows to the outside of the heat exchanger 10 through the second outflow header 15*b*. The third outflow header 15*e* is attached to a fourth side surface 12*d*, which is the side surface opposite to the third side surface 12*c*. The third fluid flowing through the flow paths 20*a* in the heat exchanger body 12 merges in the third outflow header 15*c* and flows to the outside of the heat exchanger 10 through the third outflow header 15*c*. Any or all of the first to third fluids flow to the outside of the heat exchanger 10 and then are supplied to a demand destination.

Note that the disposition positions of the inflow header 14 and the outflow header 15 are not limited to the above positions. The positions may be set in accordance with the shape of the flow paths 20*a* and the flow direction of the fluid.

The cover portion 17 has a first cover member 26 fixed to the first side surface 12*a* of the heat exchanger body 12, a second cover member 27 fixed to the second side surface 12*b* of the heat exchanger body 12, a third cover member 28 fixed to the third side surface 12*c* of the heat exchanger body 12, and a fourth cover member 29 fixed to the fourth side surface 12*d* of the heat exchanger body 12. Each cover member 26 to 29 is formed of a flat plate material.

Each cover member 26 to 29 covers the side surface of the heat exchanger body 12 in a place where the inflow header 14 and the outflow header 15 are not disposed. That is, since the first side surface 12*a* is provided with the first inflow header 14*a* and the second outflow header 15*b*, the first cover member 26 covers a portion of the first side surface 12*a* other than the portion where the first inflow header 14*a* and the second outflow header 15*b* are disposed. Therefore, the first cover member 26 covers the joint portion exposed on the first side surface 12*a* of the heat exchanger body 12. The first cover member 26 is fixed to the first inflow header 14*a* and also fixed to the second outflow header 15*b*. Therefore, no gap or a slight gap exists between the first cover member 26 and the first inflow header 14*a*. Also, no gap or a slight gap exists between the first cover member 26 and the second outflow header 15*b*.

Since the second side surface 12*b* is provided with the second inflow header 14*b* and the first outflow header 15*a*, the second cover member 27 covers a portion of the second side surface 12*b* other than the portion where the second inflow header 14*b* and the first outflow header 15*a* are disposed. Therefore, the second cover member 27 covers the joint portion exposed on the second side surface 12*b* of the heat exchanger body 12. The second cover member 27 is fixed to the second inflow header 14*b* and also fixed to the first outflow header 15*a*. Therefore, no gap or a slight gap exists between the second cover member 27 and the second inflow header 14*b*. Also, no gap or a slight gap exists between the second cover member 27 and the first outflow header 15*a*.

Since the third side surface 12*c* is provided with the third inflow header 14*c*, the third cover member 28 covers a portion of the third side surface 12*c* other than the portion where the third inflow header 14*c* is disposed. Therefore, the third cover member 28 covers the joint portion exposed on the third side surface 12*c* of the heat exchanger body 12. The third cover member 28 is fixed to the third inflow header 14*c*. Therefore, no gap or a slight gap exists between the third cover member 28 and the third inflow header 14*c*.

Since the fourth side surface 12*d* is provided with the third outflow header 15*c*, the fourth cover member 29 covers a portion of the fourth side surface 12*d* other than the portion where the third outflow header 15*c* is disposed. Therefore, the fourth cover member 29 covers the joint portion exposed on the fourth side surface 12*d* of the heat exchanger body 12. The fourth cover member 29 is fixed to the third outflow header 15*c*. Therefore, no gap or a slight gap exists between the third cover member 28 and the third outflow header 15*c*.

The cover portion 17 is welded to the heat exchanger body 12. That is, the outer peripheral portion of the first cover member 26 is welded to the first side surface 12*a* of the heat exchanger body 12 on the entire periphery. The same applies to any of the second cover member 27 to the fourth cover member 29. In this configuration, the first cover member 26 to the fourth cover member 29 are welded directly to the heat exchanger body 12. Accordingly, in an area surrounded by the welded portion, a gap is formed between the first cover member 26 and the first side surface 12*a* of the heat exchanger body 12. The same applies to the second to fourth cover members 27 to 29.

The lead-out portion 18 forms an internal flow path communicating with the gap between the cover portion 17 and the side surface of the heat exchanger body 12. The lead-out portion 18 has a first lead-out portion 18*a* formed of a tubular member fixed to the first cover member 26, a second lead-out portion 18*b* formed of a tubular member fixed to the second cover member 27, a third lead-out portion 18*c* formed of a tubular member fixed to the third cover member 28, and a fourth lead-out portion 18*d* formed of a tubular member fixed to the fourth cover member 29. An end portion of the lead-out portion 18 penetrates the cover portion 17 and is welded to the cover portion 17. Note that the lead-out portion 18 may be fixed to the cover portion 17 by fastening a screw whose sealing property is ensured.

Since the first lead-out portion 18*a* is open between the first cover member 26 and the first side surface 12*a* of the heat exchanger body 12, when the fluid leaks from the heat exchanger body 12 to the first side surface 12*a* side, the first lead-out portion 18*a* causes the fluid to flow to a preset region. Since the second lead-out portion 18*b* is open between the second cover member 27 and the second side surface 12*b* of the heat exchanger body 12, when the fluid leaks from the heat exchanger body 12 to the second side surface 12*b* side, the second lead-out portion 18*b* causes the fluid to flow to a preset region. Since the third lead-out portion 18*c* is open between the third cover member 28 and the third side surface 12*c* of the heat exchanger body 12, when the fluid leaks from the heat exchanger body 12 to the third side surface 12*c* side, the third lead-out portion 18*c* causes the fluid to flow to a preset region. Since the fourth lead-out portion 18*d* is open between the fourth cover member 29 and the fourth side surface 12*d* of the heat exchanger body 12, when the fluid leaks from the heat exchanger body 12 to the fourth side surface 12*d* side, the fourth lead-out portion 18*d* causes the fluid to flow to a preset region.

Figure 4:
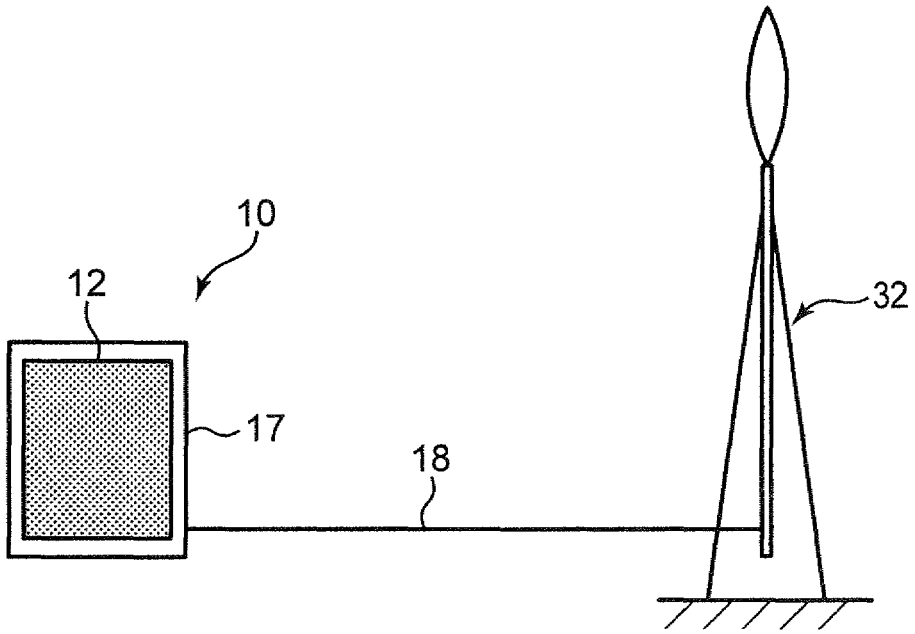
FIG. 4 is a view showing a state in which a lead-out portion of the heat exchanger is connected to a flare stack provided in a plant.

As shown in FIG. 4, the heat exchanger 10 is installed in a plant 31, and the lead-out portion 18 is connected to a flare stack 32 provided in the plant 31. That is, all of the first to fourth lead-out portions 18*a* to 18*d* constituting the lead-out portion 18 are connected to the flare stack 32. Accordingly, the fluid flowing in the lead-out portion 18 is emitted to the flare stack 32. In the flare stack 32, the fluid is burned and discharged into the atmosphere.

Figure 5:
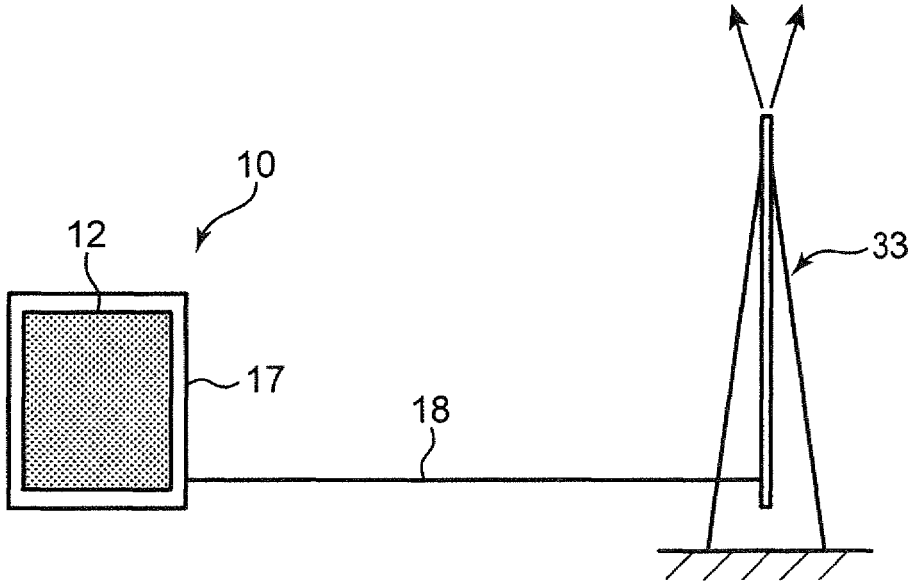
FIG. 5 is a view showing a state in which a lead-out portion of the heat exchanger is connected to a vent stack provided in the plant.
Figure 6:
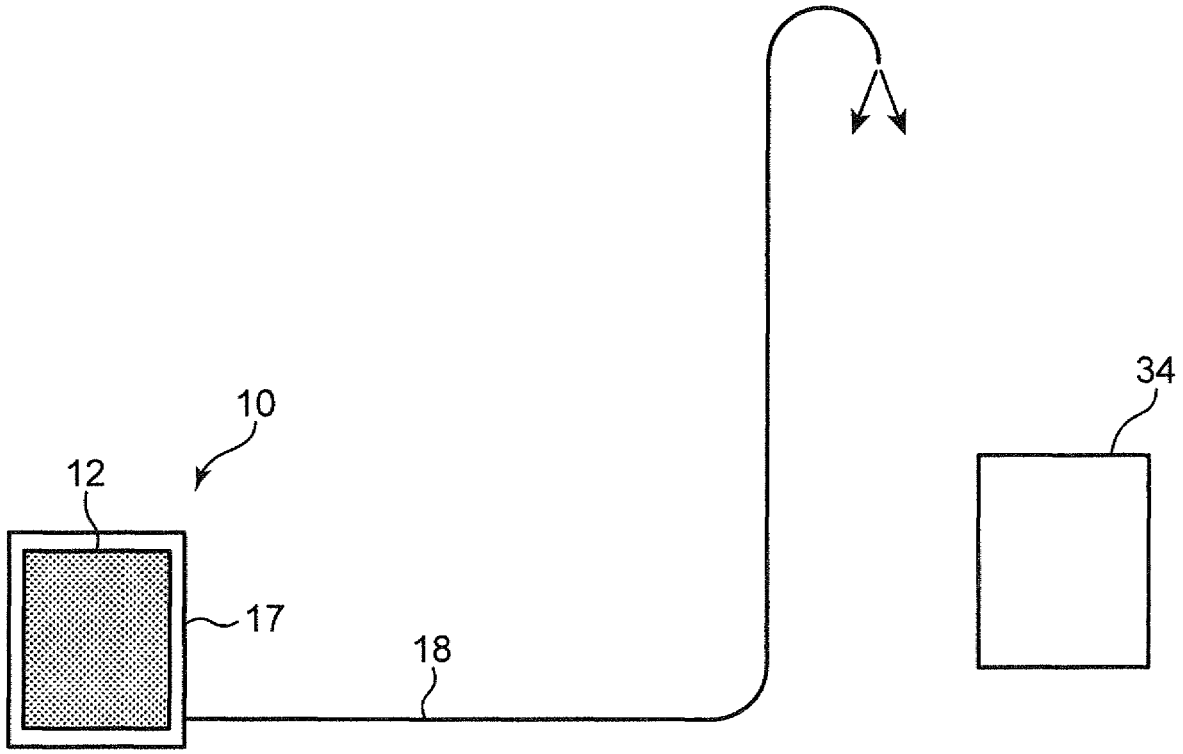
FIG. 6 is a view showing a state in which the lead-out portion of the heat exchanger extends above other equipment in the plant.

The lead-out portion 18 is not limited to be disposed up to the flare stack 32, and may extend to any area as long as it is a predetermined area set by the plant 31 installer. For example, as shown in FIG. 5, the lead-out portion 18 may be connected to a vent stack 31 installed in the plant 33. The fluid is discharged to the atmosphere through the vent stack 33. As shown in FIG. 6, the lead-out portion 18 may have a rising portion extending to a height where no other equipment 34 in the plant 31 exists. The fluid flowing through the lead-out portion 18 is discharged into the atmosphere from the tip of the rising portion. If the fluid is a gas having a density smaller than that of air, such a configuration may be adopted. Even if the fluid is a gas having a density larger than that of air, such a configuration may be adopted when the height of discharge is sufficiently high and the fluid is diffused to a level safe enough not to affect humans.

As described above, in the present embodiment, the cover portion 17 is located at a portion other than the portion where the inflow header 14 and the outflow header 15 are disposed, and covers all the joint portions exposed on the side surfaces 12*a* to 12*d* of the heat exchanger body 12. Therefore, when a fluid leaks from some of the joint portions, the fluid flows into the internal flow path of the lead-out portion 18 through the gap between the cover portion 17 and the heat exchanger body 12. Since the lead-out portion 18 extends to a predetermined region set in advance, the fluid flowing through the internal flow path is discharged to the predetermined region set in advance. Therefore, even if the fluid leaks from some of the joint portions, the leaked fluid does not accumulate around the heat exchanger 10. Therefore, even if the heat exchange operation is continued when the fluid leaks from some of the joint portions existing in the heat exchanger body 12, a problem caused by filling the periphery of the heat exchanger 10 with the fluid is less likely to occur. Therefore, an immediately repair of the heat exchanger 10 is not necessary, and the operation of the heat exchanger 10 can be continued for the time being such as a period until the next scheduled maintenance.

In the present embodiment, each cover member 26 to 29 is welded to the heat exchanger body 12 over the entire outer peripheral portion thereof, but is not welded to the heat exchanger body 12 inside the outer peripheral portion thereof. Due to this, when the fluid leaks from the joint portion located at a portion other than the portion where the inflow header 14 and the outflow header 15 are disposed, the fluid reliably flows into the gap between the cover member 26 to 29 and the heat exchanger body 12. Since the cover member 26 to 29 is directly welded to the heat exchanger body 12, sealability between the cover member 26 to 29 and the heat exchanger body 12 can be ensured. Since the lead-out portion 18 is fixed to the cover portion 17 by welding, it is also possible to ensure the sealability at the connection portion between the cover portion 17 and the lead-out portion 18.

Figure 7:
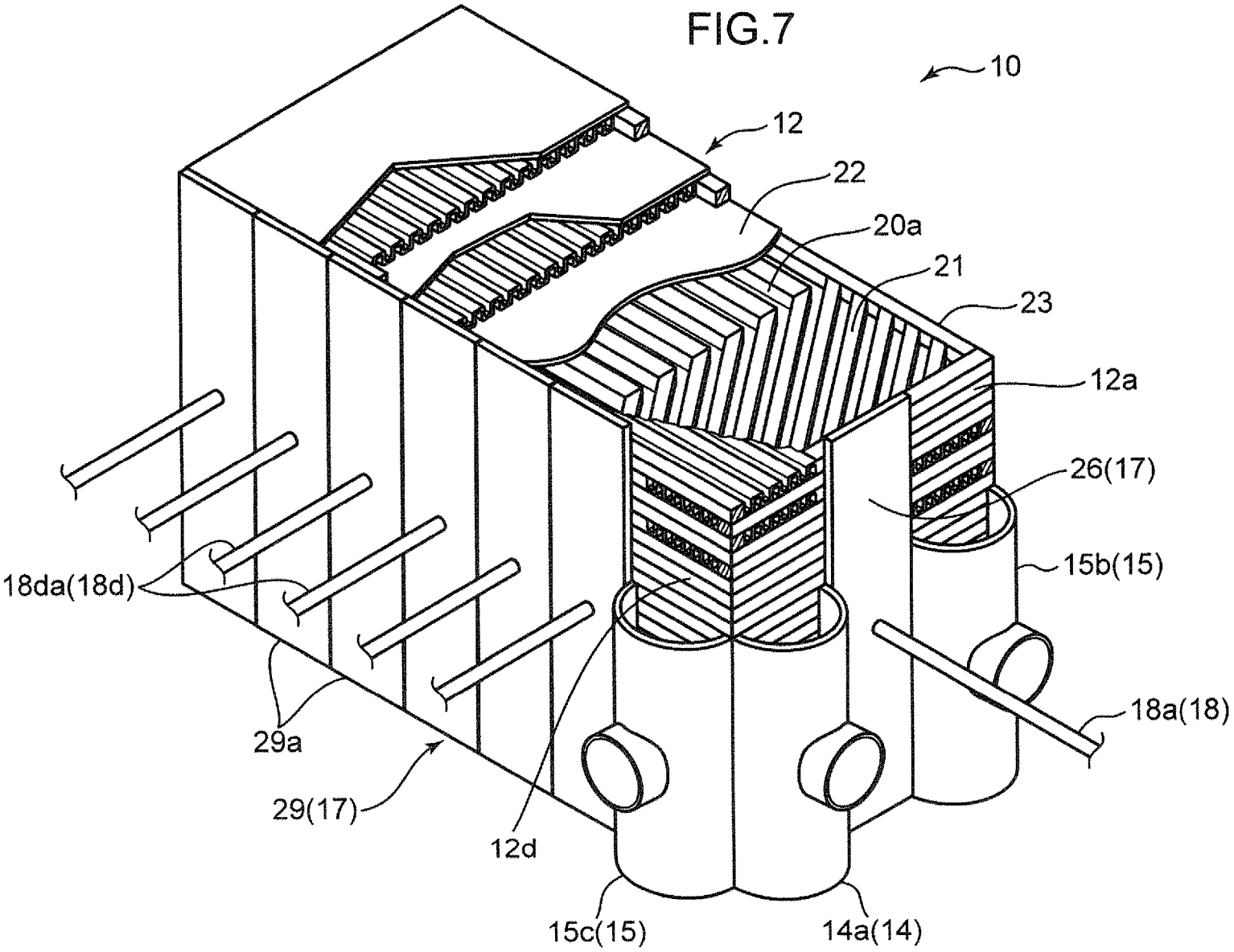
FIG. 7 is a perspective view of the heat exchanger in which the heat exchanger in a case where a fourth cover member is formed of a plurality of flat plate members is shown in a partially broken state.

The first embodiment should be considered illustrative in all respects and not restrictive. Various changes, improvements, and the like can be made without departing from the spirit of the first embodiment. In the form shown in FIG. 2, all of the first to fourth cover members 26 to 29 are formed of a single flat plate material, but instead, as shown in FIG. 7, the fourth cover member 29 may be configured to be divided into a plurality of flat plate members 29*a*. That is, the fourth cover member 29 has the plurality of separate flat plate members 29*a*. In this case, the fourth lead-out portion 18*d* has a plurality of tube members 18*da* provided on each flat plate member 29*a*.

Each flat plate member 29*a* is welded to the fourth side surface 12*d* of the heat exchanger body 12. That is, each flat plate member 29*a* is fixed to the fourth side surface 12*d* on the entire periphery of the outer peripheral portion thereof. In other words, the fourth cover member 29 is fixed to the heat exchanger body 12 at a plurality of fixing portions.

The flat plate members 29*a* are aligned in the longitudinal direction of the fourth side surface 12*d*. Therefore, in the longitudinal direction of the fourth side surface 12*d*, the length of the flat plate member 29*a* is shorter than the length of the fourth cover member 29. Therefore, the area of each flat plate member 29*a* is smaller than the area of the fourth cover member 29. Therefore, the deformation amount of each flat plate member 29*a* when a high-pressure fluid flows into the gap between the fourth cover member 29 and the heat exchanger body 12 is suppressed to be small. Also, since the flat plate member 29*a* having an area smaller than the area of the fourth cover member 29 is fixed to the fourth side surface 12*d* of the heat exchanger body 12, it becomes possible to reduce the thickness of the fourth cover member 29. That is, when the thickness of the fourth cover member 29 is designed, the thickness is set with the internal pressure to be held as the design pressure. When the fourth cover member 29 is formed of the plurality of flat plate members 29*a*, the thickness of each flat plate member 29*a* is designed in accordance with the internal pressure to be held. Therefore, the thickness of each flat plate member 29*a* is smaller than that in the case where the fourth cover member 29 is formed of a single plate material. Note that FIG. 7 shows an example in which the fourth cover member 29 is divided into the plurality of flat plate members 29*a*, but the embodiment is not limited thereto, and any of the first to third cover members 26 to 28 may be divided into a plurality of flat plate members.

Figure 8:
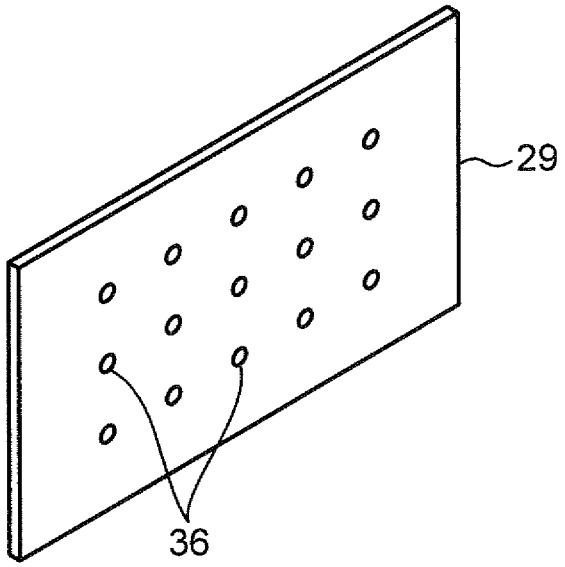
FIG. 8 is a view for explaining a configuration in which the fourth cover member is formed of one flat plate member provided with a plurality of weld portions.

FIG. 7 shows a configuration in which the fourth cover member 29 is divided into the plurality of flat plate members 29*a*, whereby the fourth cover member 29 is fixed to the fourth side surface 12*d* of the heat exchanger body 12 at a plurality of fixing portions. In contrast, FIG. 8 shows a configuration in which the fourth cover member 29 is formed of one flat plate member and is fixed to the fourth side surface 12*d* of the heat exchanger body 12 at a plurality of fixing portions. In this configuration, as shown in FIG. 8, a plurality of welding holes are formed in the fourth cover member 29 at intervals from one another, and each welding hole is provided with a weld material 36. The weld material 36 is fixed to the fourth cover member 29 and also fixed to the heat exchanger body 12. Therefore, the fourth cover member 29 is fixed to the fourth side surface 12*d* of the heat exchanger body 12 at a plurality of fixing portions. In this configuration, since the deformation of the fourth cover member 29 is prevented at a plurality of weld portions, it is possible to reduce the deformation amount of the entire fourth cover member 29. Also, it becomes possible to reduce the thickness of the fourth cover member 29. Note that not the fourth cover member 29 but any of the first to third cover members 26 to 28 may be similarly configured.

In the form of FIG. 2, the cover portion 17 is directly fixed to the side surfaces 12*a* to 12*d* of the heat exchanger body 12. On the other hand, in the form shown in FIG. 9, the cover portion 17 is fixed to the heat exchanger body 12 via a fixing member. That is, the cover portion 17 is indirectly welded to the heat exchanger body 12. Specifically, on the side surface of the heat exchanger body 12, a buildup weld (buildup material) 38 functioning as a fixing member is provided in advance, and the cover portion 17 is welded to the buildup weld 38. The buildup weld 38 is made of a metal material placed on the side surfaces 12*a* to 12*d* of the heat exchanger body 12 in a state of being raised from the surfaces of the side surfaces 12*a* to 12*d*. The cover portion 17 is disposed so as to come into contact with the buildup weld 38, and by fixing the periphery of the cover portion 17 by welding, the cover portion 17 is fixed to the heat exchanger body 12 via the buildup weld 38.

The buildup weld 38 is welded to the heat exchanger body 12. Therefore, heat generated when the buildup weld 38 is welded to the heat exchanger body 12 may cause thermal stress in the heat exchanger body 12, and microscopic damage may occur in the heat exchanger body 12. However, since the presence or absence of fluid leakage from the heat exchanger body 12 can be inspected before the cover portion 17 covers the heat exchanger body, even if the above-described damage occurs, it is possible to repair the heat exchanger body 12 before attaching the cover portion 17. In comparison with the case where the cover portion 17 is directly welded to the heat exchanger body 12, it is also possible to suppress the heat when the cover portion 17 is welded to the buildup weld 38, which is a weld material, from being transferred to the heat exchanger body 12.

Figure 9:
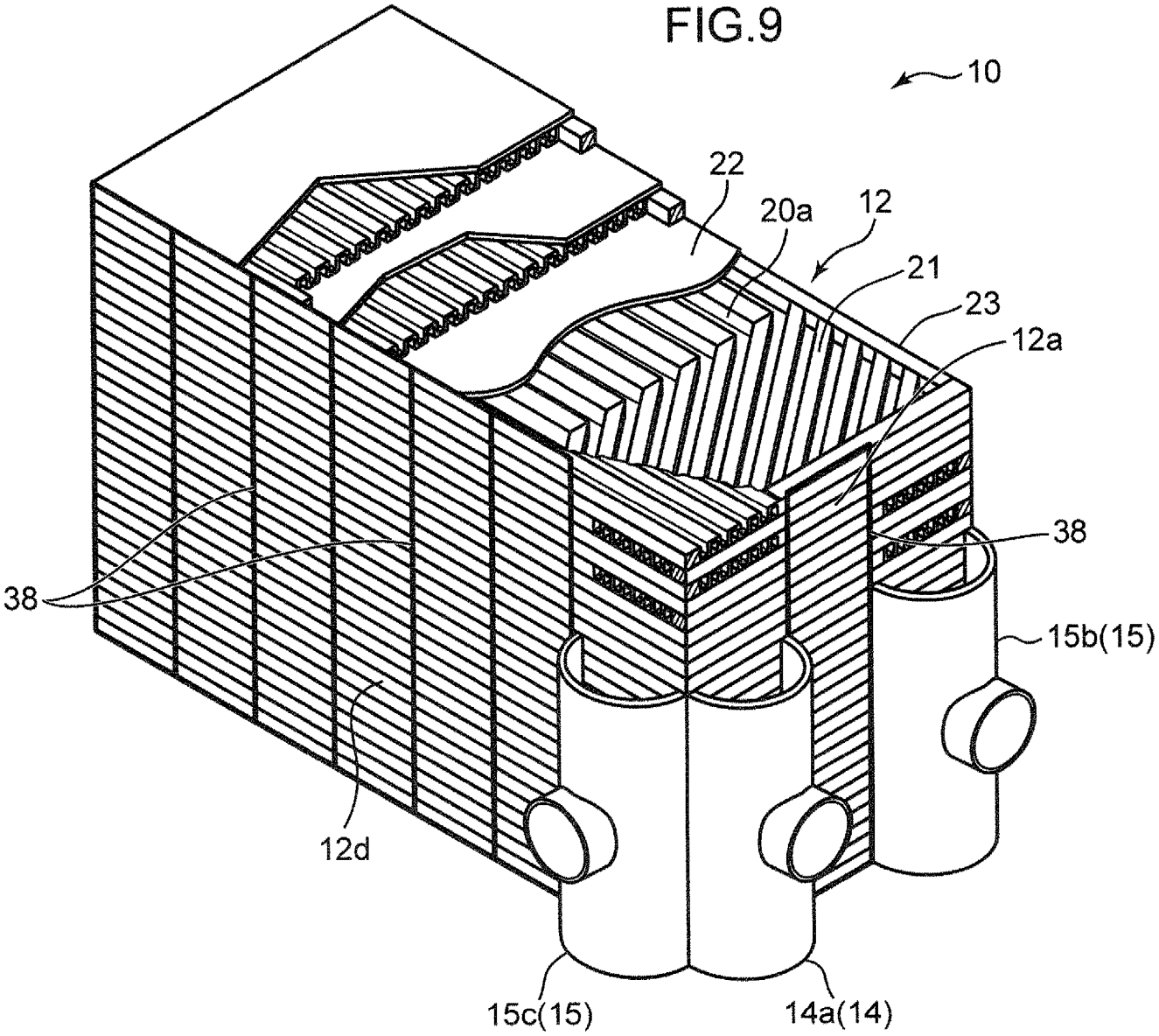
FIG. 9 is a perspective view of the heat exchanger in which the heat exchanger in a case where a portion to which the fourth cover member is fixed is provided with a buildup weld in advance is shown in a partially broken state.

As shown in FIG. 9, the weld material 38 may be disposed so as to divide the fourth side surface 12*d* into a plurality of regions. By aligning a plurality of regions surrounded by the weld material 38 in the longitudinal direction of the fourth side surface 12*d*, the width between the weld materials 38 becomes shorter compared with the case where the weld material 38 is disposed only on the outer peripheral portion of the fourth side surface 12*d*. Therefore, when a high-pressure fluid flows into the space between the fourth cover member 29 and the fourth side surface 12*d* of the heat exchanger body 12, the deformation amount of the fourth cover member 29 is suppressed to be small. In this case, the lead-out portion 18 is provided in each of the plurality of regions so as to open in each region. The fourth cover member 29 may be formed of one flat plate member or may be formed of the plurality of flat plate members 29*a* as shown in FIG. 7.

Figure 10:
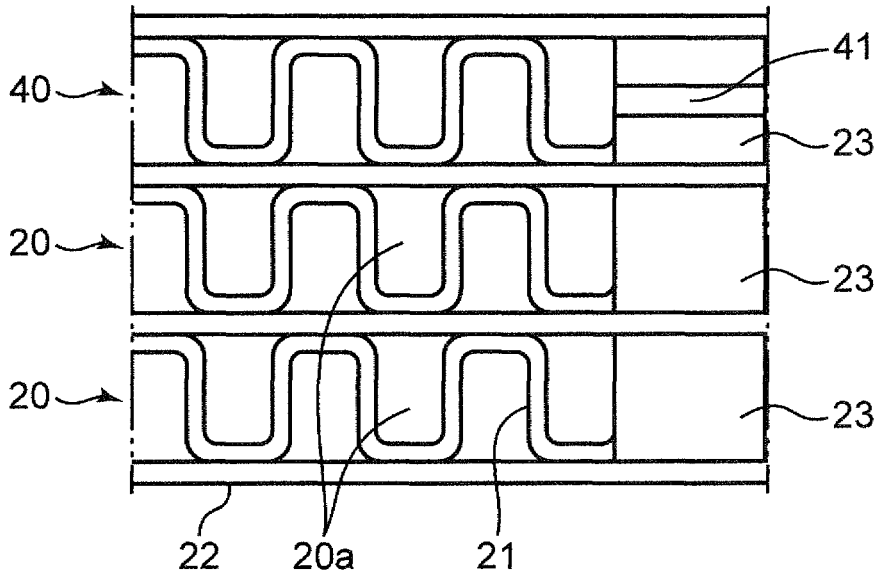
FIG. 10 is a view for explaining a configuration in which a dummy layer is provided to communicate between the fourth cover member and the heat exchanger body via the dummy layer.

In this configuration, the space formed between the fourth cover member 29 and the heat exchanger body 12 is divided into a plurality of spaces by the weld material 38. Therefore, a communication means for communicating the plurality of spaces may be provided. For example, in the heat exchanger body 12, a dummy layer 40 is provided corresponding to each space so as to be laminated on the layer portion 20. In this case, as shown in FIG. 10, the communication means is constituted by a communication hole 41 formed in the side bar 23 so as to make each space communicate with the inside of the dummy layer 40. The dummy layer 40, similar to each layer portion 20 of the heat exchanger body 12, is configured to have the corrugated plate 21, the partition plate 22 joined to one surface of the corrugated plate 21, and the side bar 23 surrounding the periphery of the corrugated plate 21. However, no fluid flows in the flow path formed in the dummy layer 40. Through the communication hole 41 and the flow path in the dummy layer 40, a plurality of spaces partitioned by the weld material 38 communicate with one another. In a case of this configuration, it is not necessary that the fourth lead-out portion 18*d* is configured to have the plurality of tube members 18*da* disposed corresponding to respective spaces, and the fourth lead-out portion 18*d* is formed of one tube member. In any of the first to third side surfaces 12*a* to 12*c*, the space formed between the cover portion 17 and the heat exchanger body 12 may be divided into a plurality of spaces by the weld material 38.

In FIG. 9, the space formed between the cover portion 17 and the heat exchanger body 12 is configured to be divided into the plurality of spaces by the weld material 38, but the embodiment is not limited thereto. That is, the weld material 38 may be configured to be disposed along the outer periphery of the fourth side surface 12*d* of the heat exchanger body 12, and the space between the fourth cover member 29 and the fourth side surface 12*d* of the heat exchanger body 12 may be configured by one space.

Figure 11:
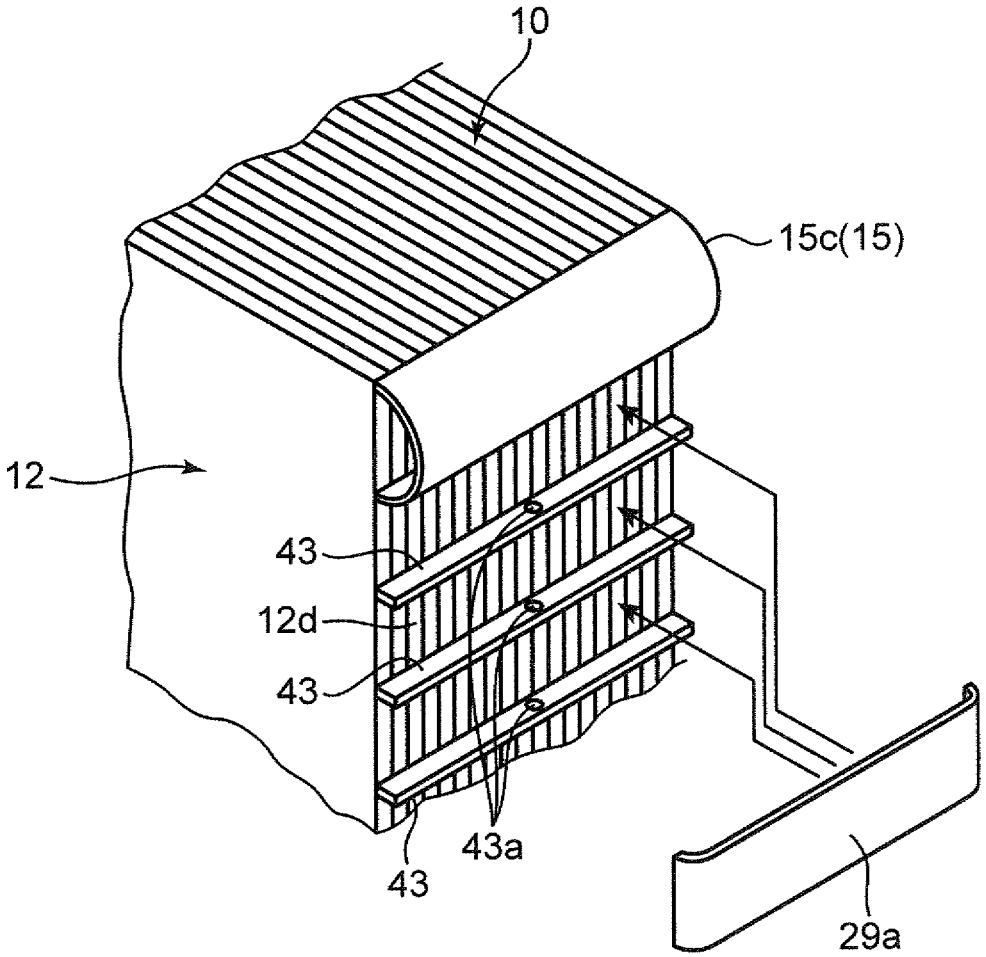
FIG. 11 is a view for explaining a configuration in which the fourth cover member is fixed to the side surface of the heat exchanger body via a plate-like body.

As shown in FIG. 11, the fixing member for fixing the cover portion 17 to the heat exchanger body 12 may be formed of a plate-like body 43 made of a flat plate material. The plate-like body 43 has a shape extending long in one direction, and one end portion in a direction orthogonal to the direction of extending long is fixed to the fourth side surface 12*d* of the heat exchanger body 12 by welding or the like. Then, the cover portion 17 is welded to the other end portion of the plate-like body 43 in the direction orthogonal to the direction of extending long. A plurality of the plate-like bodies 43 may be disposed on the fourth side surface 12*d* at intervals from one another. In this case, the fourth cover member 29 is formed of the plurality of flat plate members 29*a*, and each flat plate member 29*a* is bridged between the adjacent plate-like bodies 43. The fourth cover member 29 may be formed of one plate material. Note that the plate-like body 43 may be disposed along the outer peripheral portion of the fourth side surface 12*d* of the heat exchanger body 12 and formed in a frame shape. In this case, the fourth cover member 29 is formed of one plate material. The fixing members are not limited to those provided on the fourth side surface 12*d*, and may be provided on the first to third side surfaces 12*a* to 12*c*.

In the case where the fixing member is formed of the plurality of plate-like bodies 43 disposed at intervals from one another, the space between the fourth cover member 29 and the fourth side surface 12*d* of the heat exchanger body 12 is partitioned into a plurality of spaces by the plurality of plate-like bodies 43. In this case, as shown in FIG. 11, a communication hole 43*a* may be formed in the plate-like body 43 so as to make the adjacent spaces communicate with one another. The communication hole 43*a* functions as a communication means for communicating a plurality of spaces. Thus, it is not necessary that the fourth lead-out portion 18*d* is configured to have the plurality of tube members 18*da* disposed corresponding to the respective spaces, and the fourth lead-out portion 18*d* may have one tube member. The same applies to the first to third side surfaces 12*a* to 12*c*.

Figure 12:
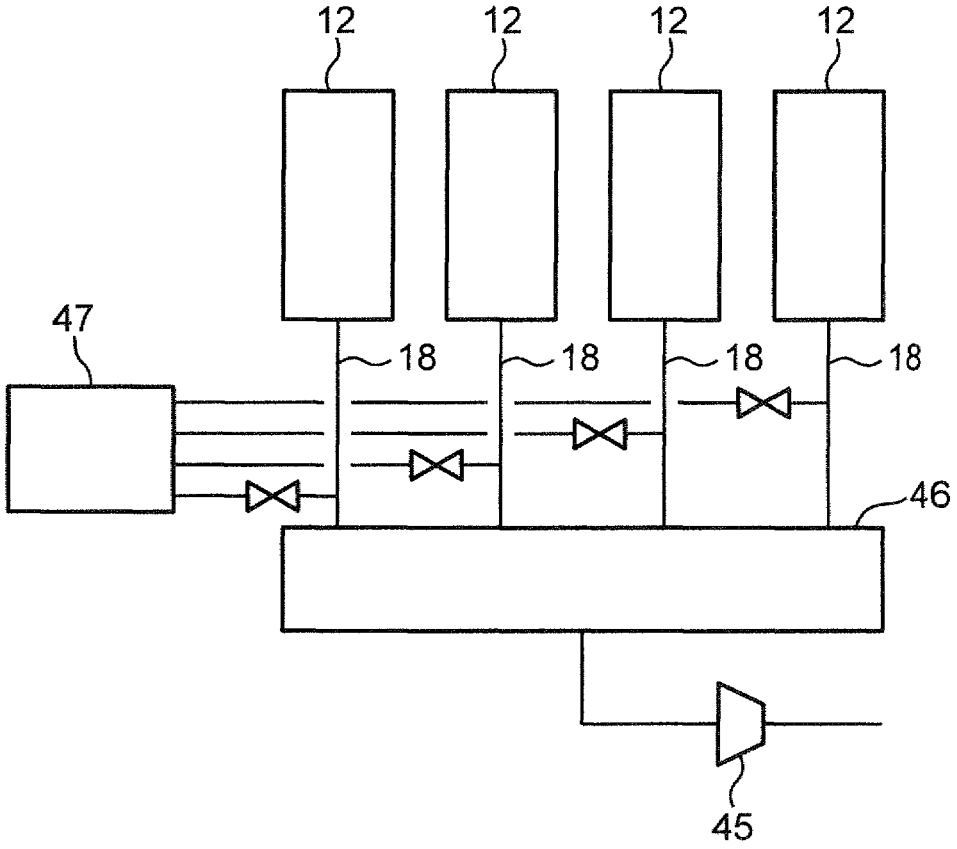
FIG. 12 is a view for explaining a configuration in which a compressor and a buffer tank are provided in the lead-out portion.

As shown in FIG. 12, the lead-out portion 18 may be provided with a compressor 45 and a buffer tank 46.

The compressor 45 compresses the fluid flowing through the internal flow path of the lead-out portion 18. By operating the compressor 45, it is possible to suck the fluid flowing into the gap between the cover portion 17 and the heat exchanger body 12 or the space formed between the cover portion 17 and the heat exchanger body 12. Therefore, it is possible to efficiently lead out the fluid from the gap or the space. Moreover, since in the lead-out portion 18, the fluid is compressed by the compressor 45 and the pressure rises, it is possible to efficiently emit the fluid even when the predetermined region where the fluid is emitted from the lead-out portion 18 has a certain pressure.

The buffer tank 46 is disposed in the lead-out portion 18 on the suction side of the compressor 45, and temporarily stores the fluid flowing toward the compressor 45. The compressor 45 is activated when the fluid is detected by a gas detector 47 connected to a suction side portion of the compressor 45 in the lead-out portion 18. That is, it takes time from the detection of the fluid by the gas detector 47 to the suction of the fluid by the compressor 45. However, since the lead-out portion 18 is provided with the buffer tank 46, it is possible to suppress a sudden pressure rise in the lead-out portion 18 within a time until the compressor 45 starts to suck the gas. Accordingly, it is also possible to suppress the increase of the pressure in the gap or in the space. Note that the buffer tank 46 can be omitted. In FIG. 12, the lead-out portions 18 extending from a plurality of the heat exchanger bodies 12 are configured to be connected to the compressor 45 and the buffer tank 46. However, the embodiment is not limited to this, and the lead-out portion 18 provided in one heat exchanger body 12 may be configured to be connected to the compressor 45 and the buffer tank 46.

Figure 13:
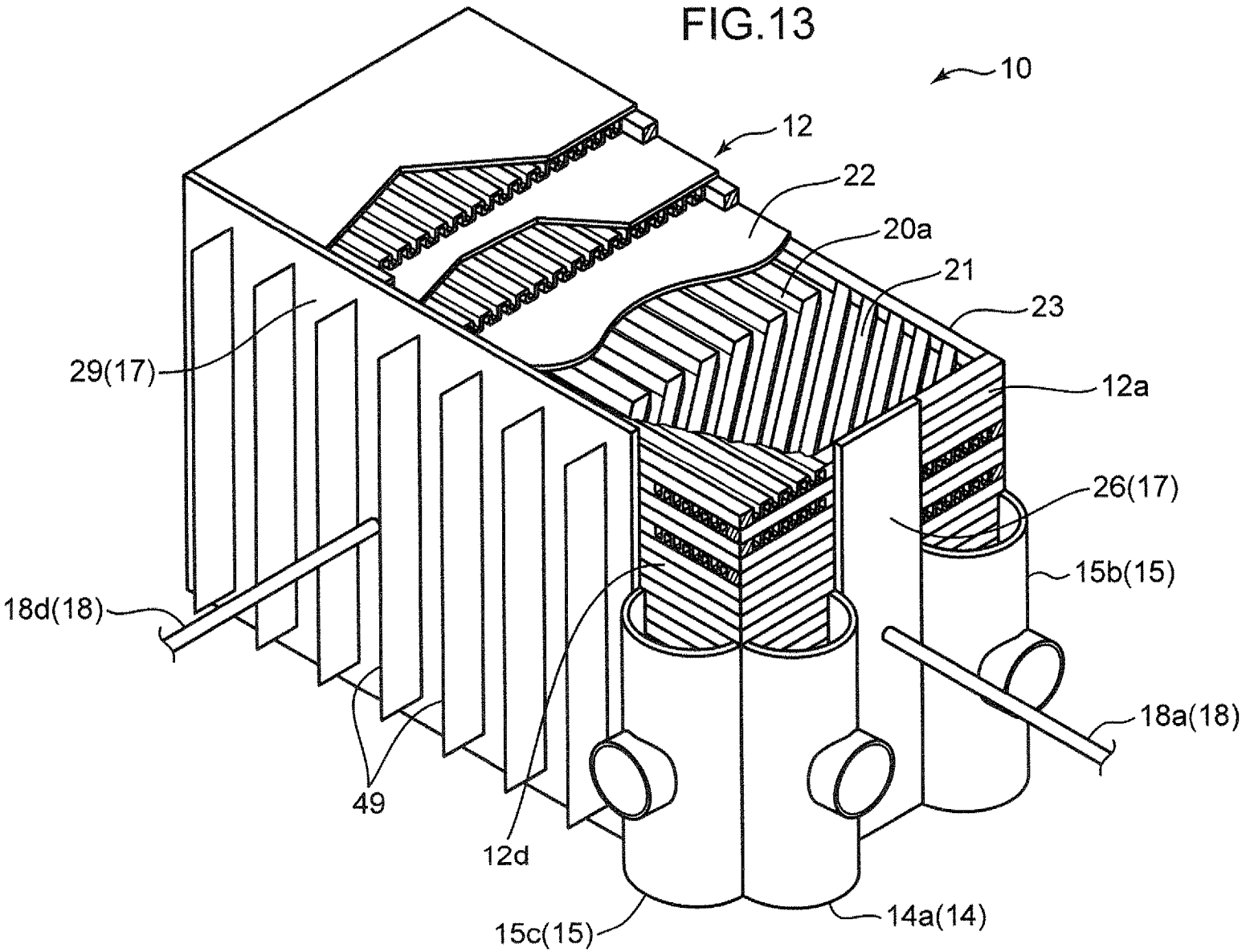
FIG. 13 is a perspective view of the heat exchanger in which the heat exchanger in a case where the fourth cover member is provided with a reinforcement rib is shown in a partially broken state.

As shown in FIG. 13, the fourth cover member 29 may be provided with a reinforcement rib 49. The reinforcement rib 49 is welded to the outer surface of the fourth cover member 29. A plurality of the reinforcement ribs 49 may be provided, or one reinforcement rib 49 may be provided. By reinforcing the fourth cover member 29 by the reinforcement rib 49, it is possible to reduce the thickness of the fourth cover member 29. Note that the reinforcement rib 49 is not limited to that fixed to the fourth cover member 29, and may be provided on the first to third cover members 26 to 28.

Figure 14A:
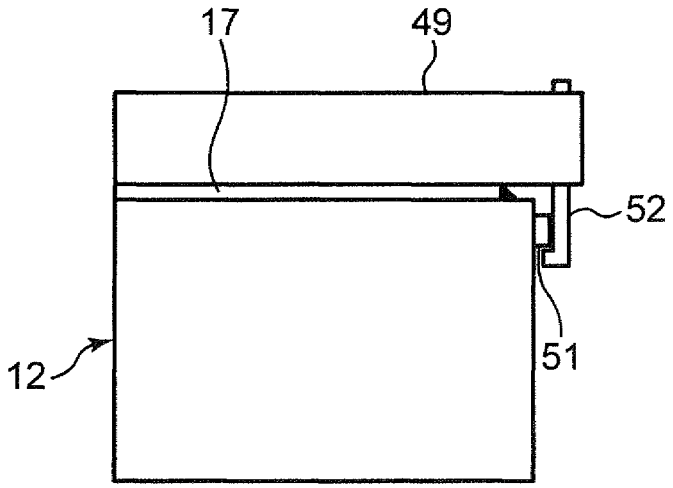
FIG. 14A is a front view for explaining a configuration in which the reinforcement rib is fixed to the fourth cover member by a mechanical means.
Figure 14B:
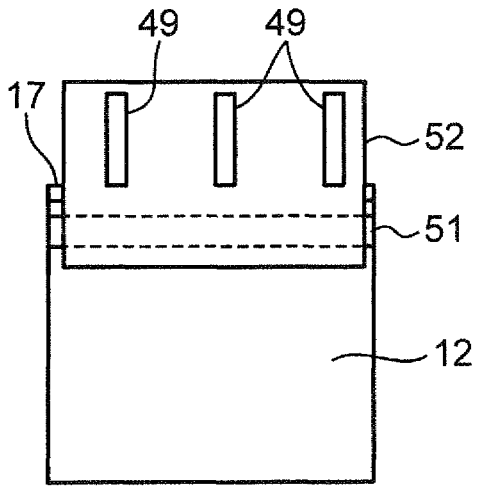
FIG. 14B is a side view for explaining a configuration in which the reinforcement rib is fixed to the fourth cover member by a mechanical means.

As shown in FIGS. 14A and 14B, the reinforcement rib 49 may be fixed to the fourth cover member 29 by a mechanical means. Specifically, a locking portion 51 is fixed to the heat exchanger body 12, and a locked portion 52 is fixed to the reinforcement rib 49. Then, by hooking the locked portion 52 to the locking portion 51 of the heat exchanger body 12, the reinforcement rib 49 is pressed against the cover portion 17. This can improve rigidity of the cover portion 17. This configuration allows the reinforcement rib 49 to be fixed to the cover portion 17 even if the material of the reinforcement rib 49 is different from the material of the cover portion 17. Accordingly, the degree of freedom in selecting the materials of the cover portion 17 and the reinforcement rib 49 is increased.

Figure 15:
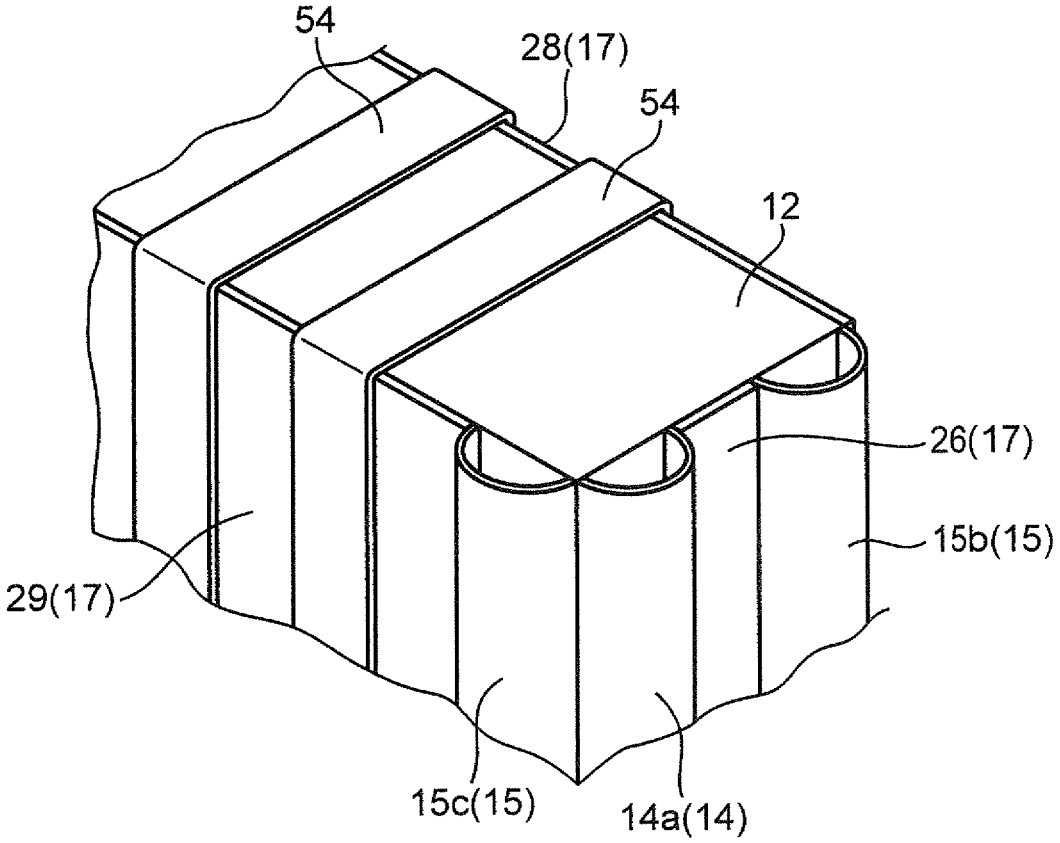
FIG. 15 is a view for explaining a configuration in which a steel band is wound around the heat exchanger body and the cover portion.

As shown in FIG. 15, a steel band 54 wound around the heat exchanger body 12 and the cover portion 17 may be provided. This configuration allows the steel band 54 to press the cover portion 17 from the outside, and it is hence possible to reinforce the cover portion 17. Therefore, it is possible to reduce the thickness of the cover portion 17.

Figure 16:
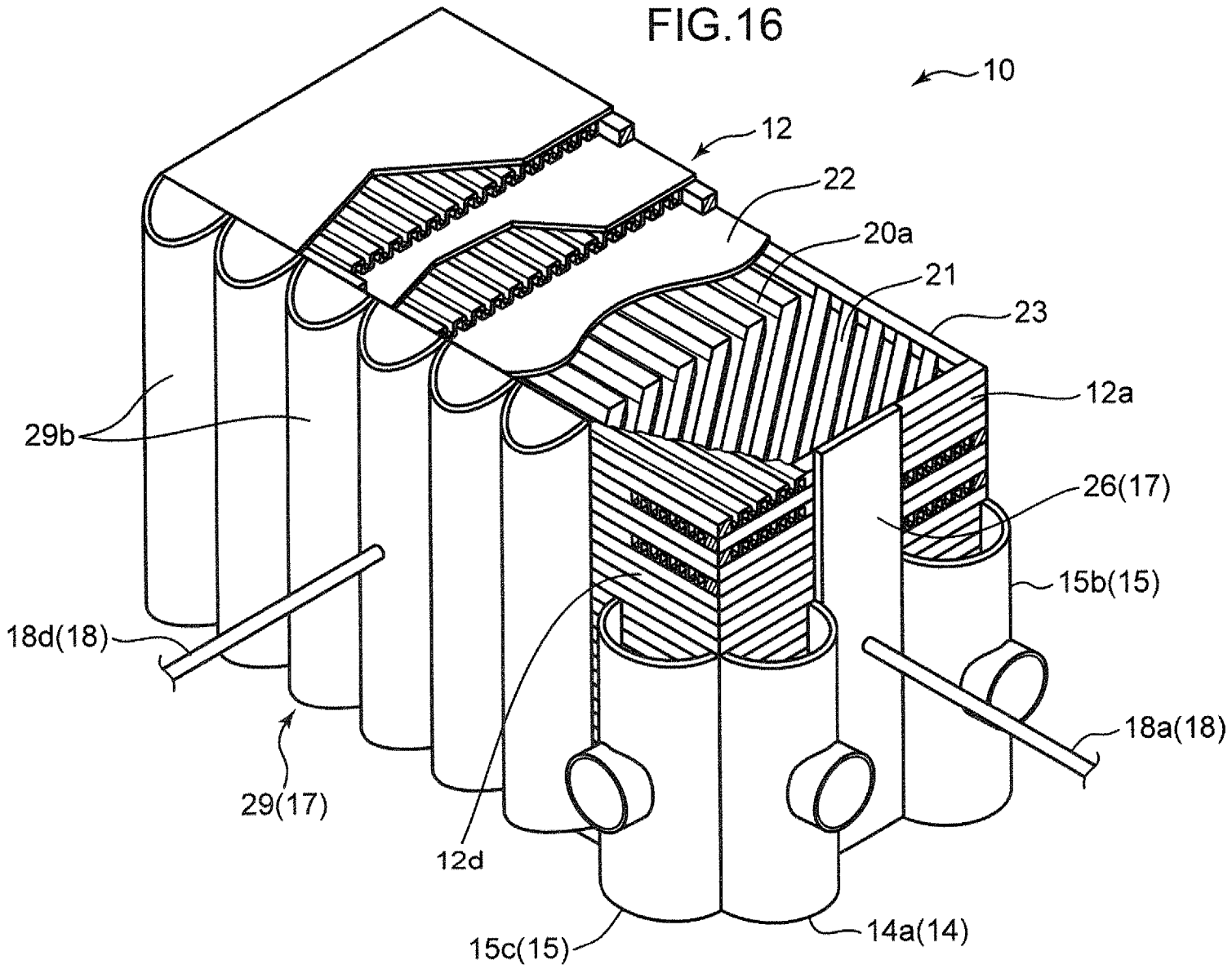
FIG. 16 is a perspective view of the heat exchanger in which the heat exchanger in a case where the fourth cover member is formed of a plurality of semi-cylindrical members is shown in a partially broken state.

As shown in FIG. 16, the fourth cover member 29 may be divided into a plurality of members 29*b*, and each member 29*b* may be formed in a semi-cylindrical shape. This configuration causes the rigidity of the fourth cover member 29 to increase, and it is hence possible to reduce the thickness of the fourth cover member 29. Note that not only the fourth cover member 29 but also the first to third cover members 26 to 28 may have the same configuration. The first to fourth cover members 26 to 29 may be formed in a semi-cylindrical shape without being divided into a plurality of members.

Figure 17:
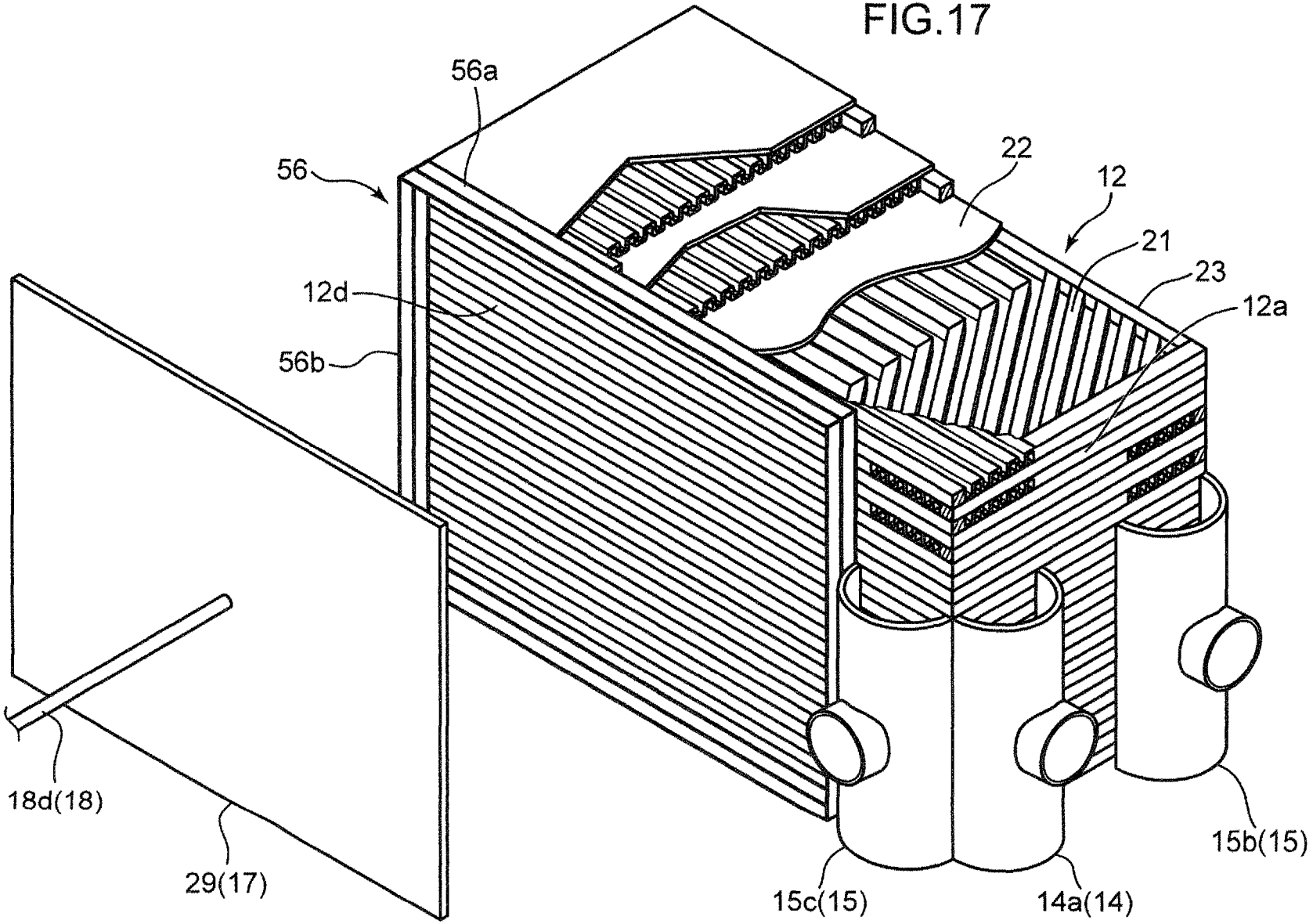
FIG. 17 is a perspective view of the heat exchanger in which the heat exchanger in a case where the fourth cover member is fixed to the heat exchanger body via a transition joint is shown in a partially broken state.

As shown in FIG. 17, when the material of the fourth cover member 29 is formed of a different kind of metal material from the material of the heat exchanger body 12, the fourth cover member 29 may be welded to the heat exchanger body 12 via a transition joint 56, which is a dissimilar material joint. The transition joint 56 has a body side portion 56*a* made of the same material as that of the heat exchanger body 12 (e.g., aluminum alloy), and a cover side portion 56*b* fixed to the body side portion 56*a* and made of the same material as that of the fourth cover member 29 (e.g., stainless steel). The transition joint 56 is also a fixing member for welding the cover portion 17 to the heat exchanger body 12. By adopting a configuration in which the transition joint 56 connects the heat exchanger body 12 and the fourth cover member 29, it is possible to provide the cover portion 17 with a higher strength, and to make the fourth cover member 29 thinner. The heat input to the heat exchanger body 12 can be reduced during welding. Note that the transition joint 56 may be adopted not for fixing the fourth cover member 29 but for fixing the first to third cover members 26 to 28.

Second Embodiment

Figure 18A:
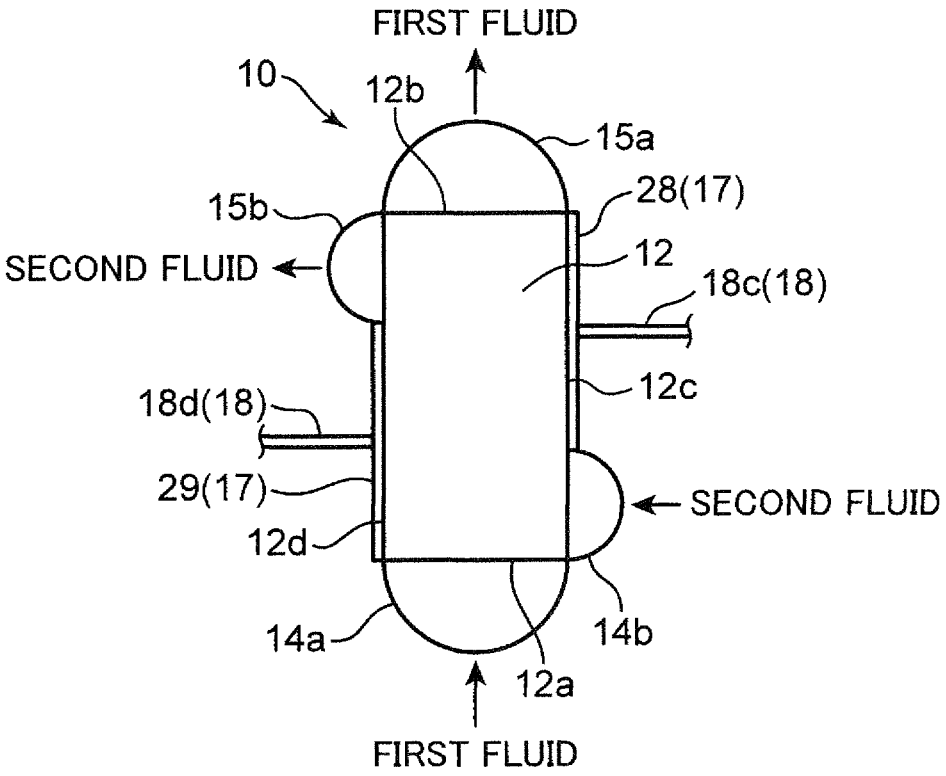
FIG. 18A is a front view showing an overall configuration of a heat exchanger according to a second embodiment.
Figure 18B:
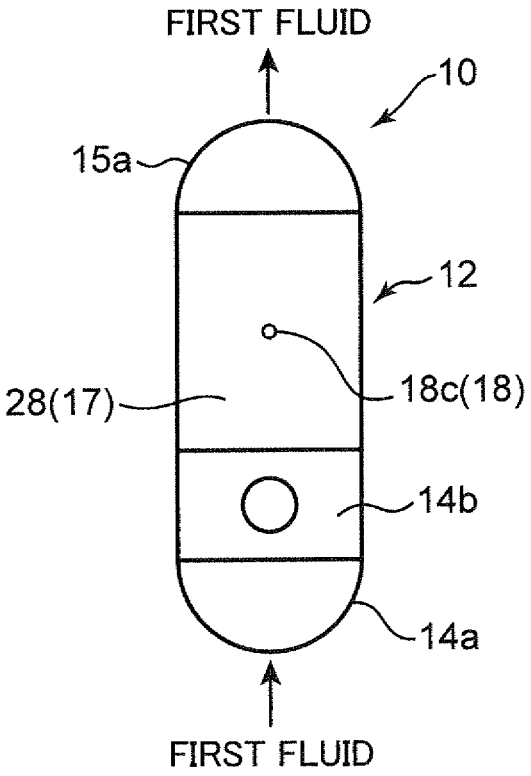
FIG. 18B is a side view showing an overall configuration of the heat exchanger according to the second embodiment.

FIGS. 18A and 18B show the second embodiment of the present invention. Here, the same components as those in the first embodiment are denoted by the same reference numerals, and a detailed description thereof will be omitted.

Figure 19:
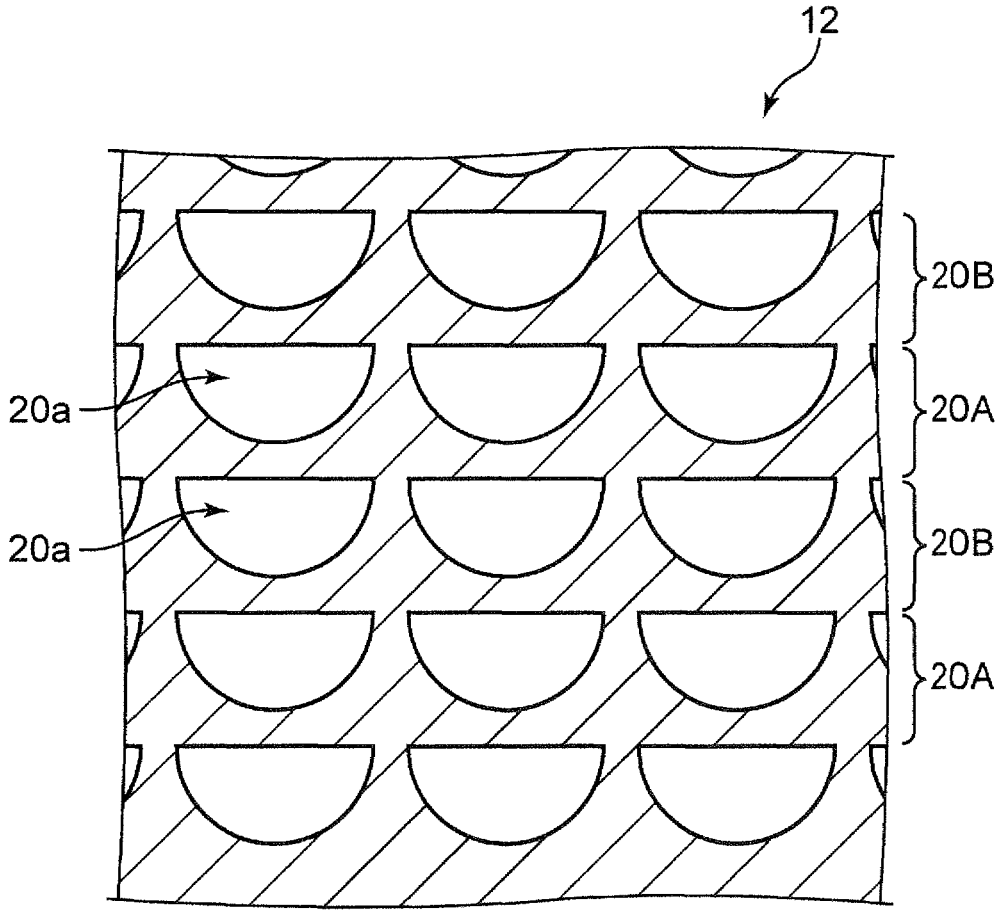
FIG. 19 is a view for explaining a layer portion formed in the heat exchanger body of the heat exchanger according to the second embodiment.

In the second embodiment, the heat exchanger body 12 is formed of a microchannel heat exchanger. As shown in FIG. 19, the heat exchanger body 12 has a first layer portion 20A and a second layer portion 20B, and these layer portions 20A and 20B are laminated alternately, for example. Each of the first layer portion 20A and the second layer portion 20B is formed of a metal plate made of a metal material having high thermal conductivity, and a plurality of overlapped metal plates are diffusion-bonded to form the heat exchanger body 12.

Here, the diffusion bonding is a method in which metal plates are brought into close contact with each other, pressurized at a temperature lower than the melting point of the material forming the metal plates and to the extent that plastic deformation is not generated as much as possible, and the metal plates are bonded to each other by utilizing diffusion of atoms generated between the bonding surfaces. Therefore, the joint portion between the adjacent layer portions 20 is not clearly seen as the boundary between the layer portions 20. Note that the metal plate is a metal plate made of stainless steel, for example.

The first layer portion 20A is formed of a metal material and is formed as a flat region having a plurality of flow paths (first flow paths) 20*a*. The second layer portion 20B is formed of a metal material and is formed as a flat region having a plurality of flow paths (second flow paths) 20*a*. The first flow paths 20*a* are aligned in one direction in the first layer portion 20A, and the second flow paths 20*a* are aligned in a direction parallel to the direction in which the first flow paths 20*a* are aligned. That is, since the metal plates having a plurality of grooves formed on the plate surface of the metal plate at intervals are superposed and diffusion-bonded, the first flow paths 20*a* and the second flow paths 20*a* are formed so as to be aligned in one direction, respectively. Each of the first flow path 20*a* and the second flow path 20*a* has a semicircular cross section. Note that the layer portion 20 is not limited to a configuration in which only the first layer portion 20A and the second layer portion 20B are formed, and the third layer portion may be formed. In this case, the first layer portion 20A, the second layer portion 20B, and the third layer portion are laminated on one another.

The cover portion 17 is attached to a pair of side surfaces of the heat exchanger body 12, which are the pair of side surfaces where the joint portion between the adjacent layer portions 20A and 20B is exposed. That is, the cover portion 17 is fixed to the side surface to which the inflow header 14 is attached and the side surface to which the outflow header 15 is attached.

In the form shown in FIGS. 18A and 18B, since the inflow header 14*a* and the outflow header 15*a* of the first fluid are provided on the entire side surface of the heat exchanger body 12, no cover member is provided on the first side surface 12*a* and the second side surface 12*b*. In this form, the cover portion 17 has the third cover member 28 covering the third side surface 12*c* to which the inflow header 14*b* of the second fluid is attached, and the fourth cover member 29 covering the fourth side surface to which the outflow header 15*b* of the second fluid is attached. However, the embodiment is not limited to this, and if the inflow header 14*a* and the outflow header 15*a* of the first fluid are provided only on a part of the side surfaces 12*a* and 12*b*, the joint portion between the layer portions 20A and 20B is exposed, and hence the cover members 26 and 27 are also attached to the joint portion. Note that joint portions between the layer portions 20A and 20B do not exist on the left and right side surfaces of the heat exchanger body 12 in FIG. 18B.

The second embodiment is different from the first embodiment in the configuration of the layer portions 20A and 20B, but the other configurations are the same as those of the first embodiment. Therefore, also in the second embodiment, the description of the forms shown in FIGS. 4 to 17 can also be incorporated.

The above embodiments will be summarized here.

(1) A heat exchanger according to the embodiment of the present invention includes a heat exchanger body having a plurality of layer portions each having a plurality of flow paths, and having a configuration in which adjacent layer portions are joined to each other in a state where the plurality of layer portions are laminated, an inflow header fixed to the heat exchanger body, the inflow header being configured that a fluid is introduced into the inflow header to flow into the plurality of flow paths, an outflow header fixed to the heat exchanger body, the outflow header being configured that a fluid flowing through the plurality of flow paths merges, a cover portion covering all joint portions of the adjacent layer portions or all joint portions of components of the layer portions, the joint portions being exposed on an outer surface of the heat exchanger body at a portion other than a portion where the inflow header and the outflow header are disposed, and a lead-out portion connected to the cover portion and forming an internal flow path communicating with a space or a gap between the cover portion and the heat exchanger body. The lead-out portion is configured to emit a fluid to a predetermined region set in advance.

In the heat exchanger according to the embodiment, the cover portion covers all the joint portions exposed on the outer surface of the heat exchanger body at a portion other than a portion where the inflow header and the outflow header are disposed. Therefore, when the fluid leaks from some of the joint portions exposed on the outer surface of the heat exchanger body, the fluid flows into the internal flow path of the lead-out portion through the gap between the cover portion and the heat exchanger body or the space formed between the cover portion and the heat exchanger body. Since the lead-out portion extends to a predetermined region set in advance, the fluid flowing through the internal flow path is discharged to the predetermined region set in advance. Therefore, even if the fluid leaks from some of the joint portions, the leaked fluid does not accumulate around the heat exchanger. Therefore, even if the heat exchange operation is continued when the fluid leaks from some of the joint portions existing in the heat exchanger body, a problem caused by filling the periphery of the heat exchanger with the fluid is less likely to occur. Therefore, it is not necessary to immediately repair the heat exchanger, and the operation of the heat exchanger can be continued for the time being such as a period until the next scheduled maintenance.

In a case where the heat exchanger is installed in the plant, the predetermined regions include, for example, safety areas such as a predetermined area set by the plant installer, an area where the plant installer permits fluid discharge, and an area where various equipment of the plant is not installed. The predetermined regions can include an area separated by a partition from an area where the heat exchanger is installed and a region that is high enough for the fluid not to affect humans (in this case, the fluid is released to the atmosphere). The predetermined regions can include a flare stack or a vent stack, or a pipe connected to the flare stack or the vent stack.

(2) The cover portion may be welded directly or indirectly to the heat exchanger body on an entire periphery of the cover portion. The lead-out portion may be fixed to the cover portion by welding or screw fastening.

In this aspect, the cover portion is welded to the heat exchanger body over its entire periphery. Due to this, when the fluid leaks from the joint portion located at a portion other than the portion where the inflow header and the outflow header are disposed, the fluid reliably flows into the gap between the cover portion and the heat exchanger body or the space formed between the cover portion and the heat exchanger body. Since the cover portion is welded directly or indirectly to the heat exchanger body, the sealability between the cover portion and the heat exchanger body can be ensured. Since the lead-out portion is fixed to the cover portion by welding or screw fastening, it is also possible to ensure the sealability at the connection portion between the cover portion and the lead-out portion.

(3) The cover portion may include a cover member disposed on one side surface of the heat exchanger body. The cover member may be fixed to the heat exchanger body at a plurality of fixing portions.

In this aspect, the deformation amount of the cover member can be suppressed even when a high-pressure fluid flows into the gap between the cover member and the heat exchanger body or the space formed between the cover member and the heat exchanger body. That is, since the cover member is fixed to the heat exchanger body at a plurality of fixing portions, the deformation amount of the cover member can be reduced as compared with a configuration in which the cover member is fixed to the heat exchanger body at only one portion such as the entire circumference of the outer peripheral portion. Also, it becomes possible to reduce the thickness of the cover member while suppressing the deformation amount to a predetermined value or less. Therefore, it becomes possible to reduce the thickness of the cover member. Therefore, even when the cover member is fixed by welding, it becomes possible to reduce the heat input to the heat exchanger body.

(4) The cover member may be configured to be divided into a plurality of members. In this case, each of the plurality of members may be fixed to the heat exchanger body on the one side surface.

In this aspect, the area of each member is smaller than the area of the cover member. Therefore, the deformation amount of each member when a high-pressure fluid flows into the gap between the cover member and the heat exchanger body or the space formed between the cover member and the heat exchanger body is suppressed to be small. Also, since the member having an area smaller than the area of the cover member is fixed to the side surface of the heat exchanger body, it becomes possible to reduce the thickness of the cover member. Therefore, even when the cover member is fixed by welding, it becomes possible to reduce the heat input to the heat exchanger body.

(5) A weld material located in a plurality of welding holes formed in the cover member and fixed to the heat exchanger body may be disposed in each of the plurality of fixing portions.

In this aspect, a weld material is disposed in each of the plurality of welding holes, and the cover portion is fixed to the heat exchanger body via this weld material. Since the deformation of the cover member at a plurality of weld portions is prevented, it is possible to reduce the deformation amount of the overall cover member. Also, it becomes possible to reduce the thickness of the cover member. Therefore, when the cover member is fixed by welding, it becomes possible to reduce the heat input to the heat exchanger body.

(6) The cover portion may be welded to a fixing member fixed to the heat exchanger body.

In this aspect, heat generated when the cover portion is welded to the fixing member is transferred to the heat exchanger body via the fixing member. Therefore, it becomes possible to reduce the heat input to the heat exchanger body during welding. Therefore, it is possible to suppress adverse effects due to heat input to the heat exchanger body by welding. Even if the fixing member is configured to be welded to the heat exchanger body, it is possible to check the leakage of the fluid after finishing the welding of the fixing member to the heat exchanger body. Therefore, it is possible to suppress the occurrence of a problem by welding the fixing member to the heat exchanger body. The fixing member is also a fixing portion of the cover portion to the heat exchanger body.

(7) The fixing member may include a buildup weld provided in advance on a fixing surface of the heat exchanger body.

In this aspect, after the weld material is fixed to the heat exchanger body, the cover portion is welded to the weld material, whereby the cover portion is subjected to buildup weld to the heat exchanger body. Since the leakage of fluid from the joint portion can be checked before covering the heat exchanger body with the cover portion, even if heat is input to the heat exchanger body when the weld material is fixed to the heat exchanger body, the problem caused by the heat input can be checked.

(8) The fixing member may include a plate-like body fixed to the heat exchanger body.

In this aspect, since the heat generated when the cover portion is welded to the plate-like body is transferred to the heat exchanger body via the plate-like body, the heat input to the heat exchanger body can be effectively reduced.

(9) The fixing member may divide the space between the cover portion and the heat exchanger body into a plurality of spaces. In this case, a communication means for communicating the plurality of spaces may be provided.

In this aspect, even when the space between the cover portion and the heat exchanger body is divided into a plurality of spaces, it is not necessary to provide the lead-out portion corresponding to each of the plurality of spaces. Therefore, the configuration of the heat exchanger can be prevented from becoming complicated.

(10) The cover portion and the heat exchanger body may be made of metal materials different from each other. In this case, the fixing member may be for riled of a dissimilar joint welded to the cover portion and welded to the heat exchanger body.

In this aspect, even when the cover portion and the heat exchange body are made of different materials from each other, the cover portion can be welded to the heat exchange body. This improves the degree of freedom in selecting the material of the cover portion, and it is hence possible to further enhance the strength of the cover portion.

(11) The lead-out portion may be provided with a compressor for compressing a fluid flowing through the internal flow path of the lead-out portion.

In this aspect, it is possible for the compressor to suck the fluid flowing into the gap between the cover portion and the heat exchanger body or the space formed between the cover portion and the heat exchanger body. Therefore, it is possible to efficiently lead out the fluid from the gap or the space. Moreover, since in the lead-out portion, the fluid is compressed by the compressor, it is possible to efficiently emit the fluid even when the predetermined region where the fluid is emitted has a certain pressure.

(12) A buffer tank may be disposed on the suction side of the compressor in the lead-out portion.

In this aspect, in a state before the compressor is activated, it is possible to reduce the rising speed of the pressure in the gap between the cover portion and the heat exchanger body or the pressure in the space formed between the cover portion and the heat exchanger body.

Accordingly, it is also possible to suppress the increase of the pressure in the gap or in the space.

(13) A reinforcement rib may be welded to the cover portion. In this aspect, since the cover portion is reinforced, the thickness of the cover portion can be reduced. Therefore, when the cover member is fixed by welding, it becomes possible to reduce the heat input to the heat exchanger body.

(14) A reinforcement rib may be mechanically attached to the cover portion. In this aspect, the reinforcement rib can be fixed to the cover portion even when the material of the reinforcement rib is different from the material of the cover portion. Therefore, the degree of freedom in selecting the material of the cover portion and the reinforcement rib is increased.

(15) The cover portion may be reinforced by winding a steel band around the heat exchanger body and the cover portion. In this aspect, since the cover portion is reinforced, the thickness of the cover portion can be reduced. Therefore, when the cover member is fixed by welding, it becomes possible to reduce the heat input to the heat exchanger body.

(16) The cover portion may include one or a plurality of semi-cylindrical members. In this aspect, since the rigidity of the cover portion is increased, the thickness of the cover portion can be reduced. Therefore, when the cover member is fixed by welding, it becomes possible to reduce the heat input to the heat exchanger body.

(17) Each of the plurality of layer portions may have a partition plate, a corrugated plate brazed to the partition plate, and a side bar surrounding the corrugated plate.

(18) The adjacent layer portions may be diffusion-bonded to each other.

As described above, it is possible to prevent a problem from occurring even if the heat exchange operation is continued when a fluid leak from the joint portion on the side surface of the heat exchanger occurs.

The invention claimed is:

1. A heat exchanger comprising:

a heat exchanger body having a plurality of layer portions each having a plurality of flow paths, and having a configuration in which adjacent layer portions are joined to each other in a state where the plurality of layer portions are laminated;

an inflow header fixed to the heat exchanger body, the inflow header being configured that a fluid is introduced into the inflow header to flow into the plurality of flow paths;

an outflow header fixed to the heat exchanger body, the outflow header being configured that a fluid flowing through the plurality of flow paths merges;

a cover portion covering all joint portions of the adjacent layer portions or all joint portions of components of the layer portions, the joint portions being exposed on an outer surface of the heat exchanger body at a portion other than a portion where the inflow header and the outflow header are disposed;

a lead-out portion connected to the cover portion and forming an internal flow path communicating with a space or a gap between the cover portion and the heat exchanger body, a fixing member fixed to the heat exchanger body and welded to the cover portion so that the fixing member bridges the plurality of layer portions adjacent to each other, the fixing member dividing a space between the cover portion and the heat exchanger body into a plurality of spaces, and a communication means formed in the fixing member for communicating to each other the plurality of spaces divided by the fixing member, wherein the lead-out portion is configured to emit a fluid to a predetermined region set in advance.

2. The heat exchanger according to claim 1, wherein the cover portion is welded directly or indirectly to the heat exchanger body on an entire periphery of the cover portion, and the lead-out portion is fixed to the cover portion by welding or screw fastening.

3. The heat exchanger according to claim 1, wherein the cover portion includes a cover member disposed on one side surface of the heat exchanger body, and the cover member is fixed to the heat exchanger body at a plurality of fixing portions.

4. The heat exchanger according to claim 3, wherein the cover member is configured to be divided into a plurality of members, and each of the plurality of members is fixed to the heat exchanger body on the one side surface.

5. The heat exchanger according to claim 3, wherein each of the plurality of fixing portions is provided with a weld material that is located in a plurality of welding holes formed in the cover member and that is fixed to the heat exchanger body.

6. The heat exchanger according to claim 1, wherein the fixing member includes a buildup weld provided in advance on a fixing surface of the heat exchanger body.

7. The heat exchanger according to claim 1, wherein the fixing member includes a plate-like body fixed to the heat exchanger body.

8. The heat exchanger according to claim 1, wherein the cover portion and the heat exchanger body are made of metal materials different from each other, and the fixing member is formed of a dissimilar joint welded to the cover portion and welded to the heat exchanger body.

9. The heat exchanger according to claim 1, wherein the lead-out portion is provided with a compressor for compressing a fluid flowing through the internal flow path of the lead-out portion.

10. The heat exchanger according to claim 9, wherein a buffer tank is disposed on a suction side of the compressor in the lead-out portion.

11. The heat exchanger according to claim 1, wherein a reinforcement rib is welded to the cover portion.

12. The heat exchanger according to claim 1, wherein a reinforcement rib is mechanically attached to the cover portion.

13. The heat exchanger according to claim 1, wherein the cover portion is reinforced by winding a steel band around the heat exchanger body and the cover portion.

14. The heat exchanger according to claim 1, wherein the cover portion includes one or a plurality of semi-cylindrical members.

15. The heat exchanger according to claim 1, wherein each of the plurality of layer portions has a partition plate, a corrugated plate brazed to the partition plate, and a side bar surrounding the corrugated plate.

16. The heat exchanger according to claim 1, wherein the adjacent layer portions are diffusion-bonded to each other.

* * * * *